US007594849B2

(12) United States Patent
Cannon

(10) Patent No.: US 7,594,849 B2
(45) Date of Patent: Sep. 29, 2009

(54) METHOD AND APPARATUS FOR SELECTING PAY LINES BASED ON A PARTIAL OUTCOME OF A SLOTS GAME

(75) Inventor: Lee E. Cannon, Bozeman, MT (US)

(73) Assignee: IGT, Reno, NV (US)

( * ) Notice: Subject to any disclaimer, the term of this patent is extended or adjusted under 35 U.S.C. 154(b) by 540 days.

(21) Appl. No.: 11/042,001

(22) Filed: Jan. 24, 2005

(65) Prior Publication Data

US 2005/0124406 A1 Jun. 9, 2005

Related U.S. Application Data

(62) Division of application No. 10/039,185, filed on Dec. 31, 2001, now abandoned.

(51) Int. Cl.
*A63F 9/24* (2006.01)

(52) U.S. Cl. ..... 463/16

(58) Field of Classification Search ..... 463/16
See application file for complete search history.

(56) References Cited

U.S. PATENT DOCUMENTS

| | | | |
|---|---|---|---|
| 4,099,722 | A | 7/1978 | Rodesch et al. |
| 4,805,907 | A | 2/1989 | Hagiwara |
| 5,046,736 | A | 9/1991 | Bridgeman et al. |
| 5,100,137 | A | 3/1992 | Fulton |
| 5,152,529 | A | 10/1992 | Okada |
| 5,167,413 | A | 12/1992 | Fulton |
| RE34,244 | E | 5/1993 | Hagiwara |
| 5,251,897 | A | 10/1993 | Fulton |
| 5,411,257 | A | 5/1995 | Fulton |
| 5,511,781 | A | 4/1996 | Wood et al. |
| 5,633,993 | A | 5/1997 | Redmann et al. |
| 5,695,188 | A | 12/1997 | Ishibashi |
| 5,766,074 | A | 6/1998 | Cannon et al. |
| 5,807,172 | A | 9/1998 | Piechowiak |
| 5,807,177 | A | 9/1998 | Takemoto et al. |
| 5,820,460 | A | 10/1998 | Fulton |

(Continued)

FOREIGN PATENT DOCUMENTS

| | | |
|---|---|---|
| EP | 0 840 256 | 5/1998 |

(Continued)

OTHER PUBLICATIONS

Kansil, "Bicycle, Official Rules of Card Games", The United States Playing Card Company, Cincinnati OH, 90th Edition, 2001.

(Continued)

*Primary Examiner*—Corbett B Coburn
(74) *Attorney, Agent, or Firm*—K&L Gates LLP

(57) ABSTRACT

A method and apparatus for playing a partial outcome reel-type slot machine game. To initiate play, a player places at least one wager in the slot machine. At least one partial outcome is generated and displayed by the slot machine in a pattern which may be, depending on the game architecture, determined by the slot machine or selected by the player. The player then strategically selects one or more pay lines based on the displayed partial outcome. The final outcome is generated by the slot machine and the player is rewarded if a winning combination is present in the selected pay line or lines.

43 Claims, 13 Drawing Sheets

U.S. PATENT DOCUMENTS

| | | | |
|---|---|---|---|
| 5,855,515 | A | 1/1999 | Pease et al. |
| 5,876,284 | A | 3/1999 | Acres et al. |
| 5,882,259 | A | 3/1999 | Holmes, Jr. et al. |
| 5,890,962 | A | 4/1999 | Takemoto |
| 5,967,518 | A | 10/1999 | Rowe |
| 5,971,849 | A | 10/1999 | Falciglia |
| 6,027,115 | A | 2/2000 | Griswold et al. |
| 6,048,269 | A | 4/2000 | Burns et al. |
| 6,089,976 | A | 7/2000 | Schneider et al. |
| 6,159,097 | A | 12/2000 | Gura |
| 6,203,429 | B1 | 3/2001 | Demar et al. |
| 6,213,875 | B1 | 4/2001 | Suzuki |
| 6,224,482 | B1 | 5/2001 | Bennett |
| 6,251,013 | B1 | 6/2001 | Bennett |
| 6,270,411 | B1 | 8/2001 | Gura et al. |
| 6,279,902 | B1 | 8/2001 | Yamazaki et al. |
| 6,309,301 | B1 | 10/2001 | Sano |
| 6,411,276 | B1 | 6/2002 | Braun et al. |
| 6,537,150 | B1 | 3/2003 | Luciano et al. |
| 6,702,671 | B2 | 3/2004 | Tarantino |
| 2003/0017865 | A1 | 1/2003 | Beaulieu et al. |

FOREIGN PATENT DOCUMENTS

| | | | |
|---|---|---|---|
| EP | 1 054 368 | | 11/2000 |
| EP | 1 082 979 | | 3/2001 |
| EP | 1 083 531 | | 3/2001 |
| GB | 2 193 441 | | 2/1998 |
| GB | 2316214 | * | 2/1998 |
| WO | WO 99/10849 | | 3/1999 |
| WO | WO 01/74464 | | 10/2001 |

OTHER PUBLICATIONS

Adams Family, IGT, (1999).

Legato, "Creepy and Kooky; IGT's 'The Addams Family' mines '60s-sitcom culture to create a wildly entertaining slot," Strictly Slots, vol. 2, No. 8 (Jul. 2000).

International Search Report (counterpart PCT application).

Written Opinion (counterpart PCT application).

International Preliminary Examination (counterpart PCT application).

International Search Report (counterpart PCT application), 2004.

Written Opinion (counterpart PCT application), 2004.

International Preliminary Examination (counterpart PCT application), 2004.

* cited by examiner

METHOD AND APPARATUS FOR SELECTING PAY LINES BASED ON A PARTIAL OUTCOME OF A SLOTS GAME

CROSS-REFERENCE TO RELATED APPLICATIONS

This application is a divisional of U.S. patent application Ser. No. 10/039,185, filed Dec. 31, 2001 and entitled "METHOD AND APPARATUS FOR SELECTING PAY LINES BASED ON A PARTIAL OUTCOME OF A SLOTS GAME", which is now abandoned, the entire contents of which are hereby incorporated by reference.

BACKGROUND OF THE INVENTION

1. Field of the Invention

The present invention relates to casino gaming machines. More particularly, the present invention relates to slot machines. The gaming activity of the present invention provides methods and apparatus for play of a slot machine game, wherein a player is enabled to strategically select pay lines based on a partial outcome of the game.

2. State of the Art

Gaming establishments, or casinos, have proliferated in recent years and compete against each other to attract players. The casinos must provide entertaining and exciting casino games to attract new players and retain established players. Repetitively attracting players becomes increasingly difficult because the traditional casino games become well played and tiresome for the players. To maintain player interest, the gaming industry must continually develop new and entertaining games.

The majority of the new games are variations on standard casino gaming machines, such as the ubiquitous reel-type slot machine, which historically has been among the most lucrative sources of income for a casino. The chief drawback of slot machines is that minimal player participation is required in achieving the final outcome of the slot machine game. The conventional slot machine in use today is typically a stand-alone device intended to be played by a single player. The player simply inserts money and actuates the device by pushing a button or pulling a lever, while the device selects the outcome and informs the player if he or she wins or loses. The lack of player participation in the game leads to boredom and, ultimately, the loss of the player as a revenue source. Although other gaming activities and machines have evolved with the advances of newer technology in casino gaming machines, the development of newer, more entertaining slot machines has lagged behind other recent technological advances.

In an attempt to attract players, some improvements have been incorporated into slot machines to increase their entertainment value. Among these improvements is the use of a plurality and variety of pay lines to increase player interest. For example, the selection of multiple pay lines by a player increases the excitement of the slot machine because more than one winning combination may be achieved. The increased complexity of multiple pay lines sparks player interest as the player learns to recognize the various winning pay lines. The development of multiple pay line slot machines is disclosed in several U.S. patents. For example, U.S. Pat. No. 4,099,722 to Rodesch, dated Jul. 11, 1978, describes a three-reel slot machine with five pay lines. The pay lines include three horizontal and two diagonal pay lines. U.S. Pat. RE 34,244 to Hagiwara, dated May 11, 1993, describes three vertical pay lines in addition to the five pay lines described by Rodesch. U.S. Pat. No. 5,807,172 to Piechowiak, dated Sep. 15, 1998, describes a 3×3 display of indicia wherein the pay lines include multi-directional diagonal pay lines.

The patents described above describe slot machine games where the pay lines are selected by a player prior to learning the final outcome of the game. Typically, the multiple pay lines of slot machine games are simultaneously played by inserting more money than for playing a single pay line. The pay line configurations are determined by the gaming machine and the odds of the player winning depend, at least in part, on the number of pay lines activated by the player.

Other advances in slot machines have been employed to spark player interest. These advances include enhancing the perceived payoff value of the game by using scatter-pay wins and unusually shaped pay lines in addition to the use of multiple pay lines. The more varied pay line configurations as well as scatter-pay wins may be readily implemented when the mechanical reels of traditional slot machines are replaced with video simulations of the reels and their movement. These video simulations provide a wide range of indicia (e.g., symbols) displayed by the slot machine reels and are enabled by the use of a microprocessor in association with suitable video graphics, as known in the art. Winning combinations are determined as a result of matching the game's pay table with the presence on each pay line of indicia selected by random number generation. These machines afford more opportunities to win through the random outcome generated by the microprocessor and displayed as video-simulated reels. When placing bets on multiple pay lines, the player increases his chances of achieving a winning combination by wagering more money on multiple pay lines.

Further efforts have also been implemented to make slot machine play more attractive to casino patrons. These efforts include systems which offer a plurality of slot machines which are electronically networked together and congregated about a common area. In U.S. Pat. No. 4,805,907 to Hagiwara et al. ("Hagiwara"), a system is disclosed in which a plurality of subordinate slot machines have their outputs connected to a main machine for controlling the game and having a large display thereon. The large display on the main machine is identical to the display shown on each subordinate machine and allows the players and spectators to observe the progress and results of a game. Hagiwara asserts that the simulated team play creates "a feeling of togetherness" which attracts more players and consequently brings about more profit to the slot machine owner.

To increase the opportunity to win, some players prefer to play several slot machines (or gaming machines of other various types) at once. The strategy employed by these players is that the odds of achieving a winning combination will be increased by generating more spins of the slot machines in a given period of time. Typically, a player playing two or more gaming machines at once will move back and forth between the machines to deposit money, wager credits and initiate play. Since the player is playing multiple games at once, the amounts of money cumulatively wagered by the player will typically be greater. However, there are several disadvantages to this mode of play. First, players may find moving between several slot machines inconvenient and ergonomically difficult, particularly when a player desires to engage in an increased rate of play. Second, during peak hours, players playing multiple machines may prohibit other casino patrons from partaking in and enjoying games of chance on those "partially" occupied machines. Third, from a casino operator's point of view, multiple machines used for concurrent, but slower, play by a single player may take up valuable floor space that could otherwise be used to optimize revenues.

U.S. Pat. No. 5,890,962 to Takemoto ("Takemoto") attempts to solve certain of the aforementioned disadvantages of a single player playing multiple machines by disclosing a video slot machine display having multiple individual display parts which each make up a 3×3 display of indicia (each display part having nine symbols arranged to simulate three reels). In one exemplary embodiment, each of the display parts has five available pay lines. Takemoto also discloses a game where a player may select one or more individual display parts and any number of available pay lines for simultaneous play. Takemoto further discloses allowing players to bet lines extending to symbols which span across two or more selected displays. In a further embodiment, Takemoto discloses a method of play that may result in a "big win," wherein each of a predetermined number of continuous display parts in the horizontal, vertical or diagonal direction is determined to have individual wins. While advantageously providing new types of games and reducing floor space that might otherwise be used by a single player attempting concurrent play on multiple gaming machines, the disclosure of Takemoto is somewhat limited in terms of display options, player options and methods of play. For example, the device of Takemoto is restricted to slot machine play where all simulated reels are configured to be activated simultaneously and the individual display parts are taught to be in fixed positions in an array on the gaming machine display.

Although the above-described patents have increased the complexity and sparked some new interest in conventional slot machine games, the cited patents do not allow a player to strategize or tactically determine the outcome of a single game. Therefore, a method of playing a slot machine game that enables a player to use his or her mental skills to strategically and tactically select pay lines that produce the greatest probability of achieving a favorable outcome is needed and would be an improvement in the art.

BRIEF SUMMARY OF THE INVENTION

The present invention comprises a method of playing a slot machine game that enables a player to use his or her mental skills to strategically and tactically select active pay lines after a partial outcome of a slot machine game is displayed to the player. For example, on a three-reel slot machine, one of the reels is stopped while the remaining two reels continue to spin. At this point, the player may select the pay lines he or she desires based on the partial outcome indicated by the one stopped reel. On a conventional three-reel slot machine with multiple pay lines, there will typically be five or seven different pay lines for the player to select. The pay lines may form a continuous geometric pattern or a zigzag pattern across the reels. In the present invention, the display of the partial outcome to the player allows the player to create a higher probability of winning by selecting pay lines containing bonus symbols, such as "WILD," symbols which may produce a greater probability of winning.

The partial outcome display enhances game play by providing the player with insight into the number of possible pay lines that may provide a higher probability of winning. The selection of higher probability pay lines creates a challenge for the player to discover and evaluate a potentially greater return. Additionally, searching for these pay lines increases game excitement for the players as they try to maximize their winnings from the game.

In addition, a player may be provided an opportunity to alter another game parameter before a final outcome is generated. For example and without limitation, after a partial outcome is generated, a player may be provided with at least one opportunity to designate a symbol as a "WILD" symbol.

As used herein, the terms "game," "gaming" and "game of chance" include and encompass not only games having a random or arbitrary outcome, but also such games which also invite or require some player input to the game having at least a potential for affecting a game outcome. Such player input is generally termed "skill" whether or not such input is, in actuality, beneficial in terms of game outcome.

BRIEF DESCRIPTION OF THE SEVERAL VIEWS OF THE DRAWINGS

The nature of the present invention as well as other embodiments of the present invention may be more clearly understood by reference to the following detailed description of the invention, to the appended claims, and to the several drawings herein, wherein:

DETAILED DESCRIPTION OF THE INVENTION

Generally, the present invention provides new and enhanced methods of using gaming machines. While the invention is described in terms of certain specific embodiments, it is by no means so limited. Specific details of these embodiments are set forth in order to provide a thorough understanding of the present invention. It will be apparent, however, that the present invention may be practiced without limitation to many of the specific details presented herein.

Figure 1:
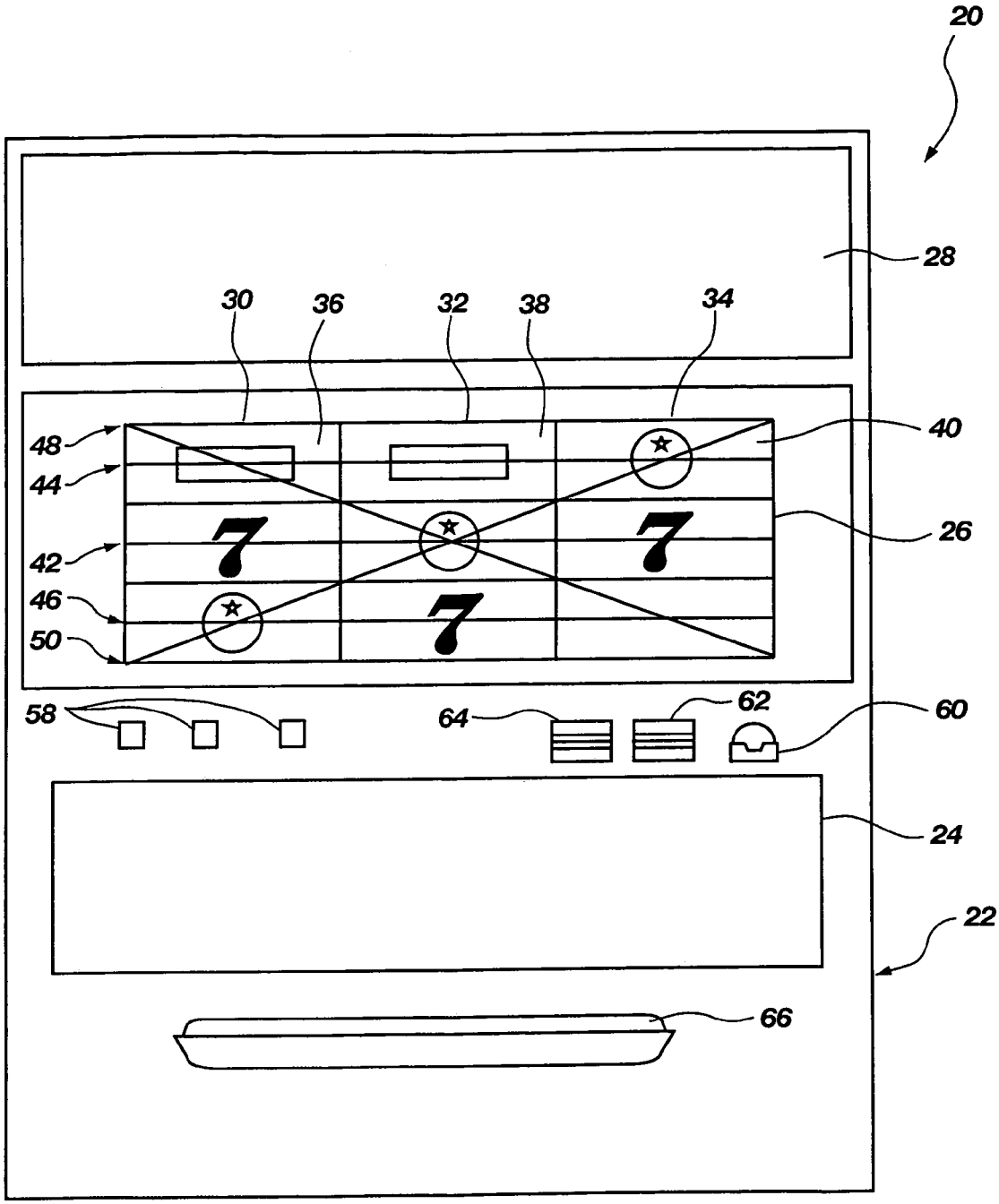
Fig. 1 (PRIOR ART)
FIG. 1 is a front elevation of a conventional, prior art electronic gaming slot machine.

Referring now to FIG. 1, there is shown is a perspective view of a conventional gaming machine known in the prior art and configured as a slot machine 20. The slot machine 20 comprises an exterior housing 22, a glass midsection 24, a main display 26 and an upper glass portion 28. Main display 26 includes windows 30, 32 and 34. In each of windows 30, 32 and 34 is a single reel 36, 38 and 40 of the slot machine 20. Spanning windows 30, 32 and 34 are various pay lines, including horizontal pay lines 42, 44 and 46 and diagonal pay lines 48 and 50. Upon the deposit of an appropriate amount of currency recognized by the slot machine 20, one or more of the various pay lines may be selected by a player, thus allowing for multiple winning combinations. The upper glass portion 28 and glass mid-section 24 typically contain printed information conveying various thematic, instructive, and informative details, such as a pay table display, relating to the operation of slot machine 20. Upper glass portion 28 and glass mid-section 24 are also typically backlit so that information printed on them is readily visible to players of the machine. Play buttons 58 are provided between the glass mid-section 24 and the main display 26 and allow the player to control operation of the slot machine 20. A coin acceptor 60, bill acceptor/validator 62 and debit card/credit card/casino card input device 64 are provided near the play buttons 58 for operation of the slot machine 20. A coin tray 66 is provided near the lower third of slot machine 20 to collect coin payouts resulting from winning plays.

Figure 2:
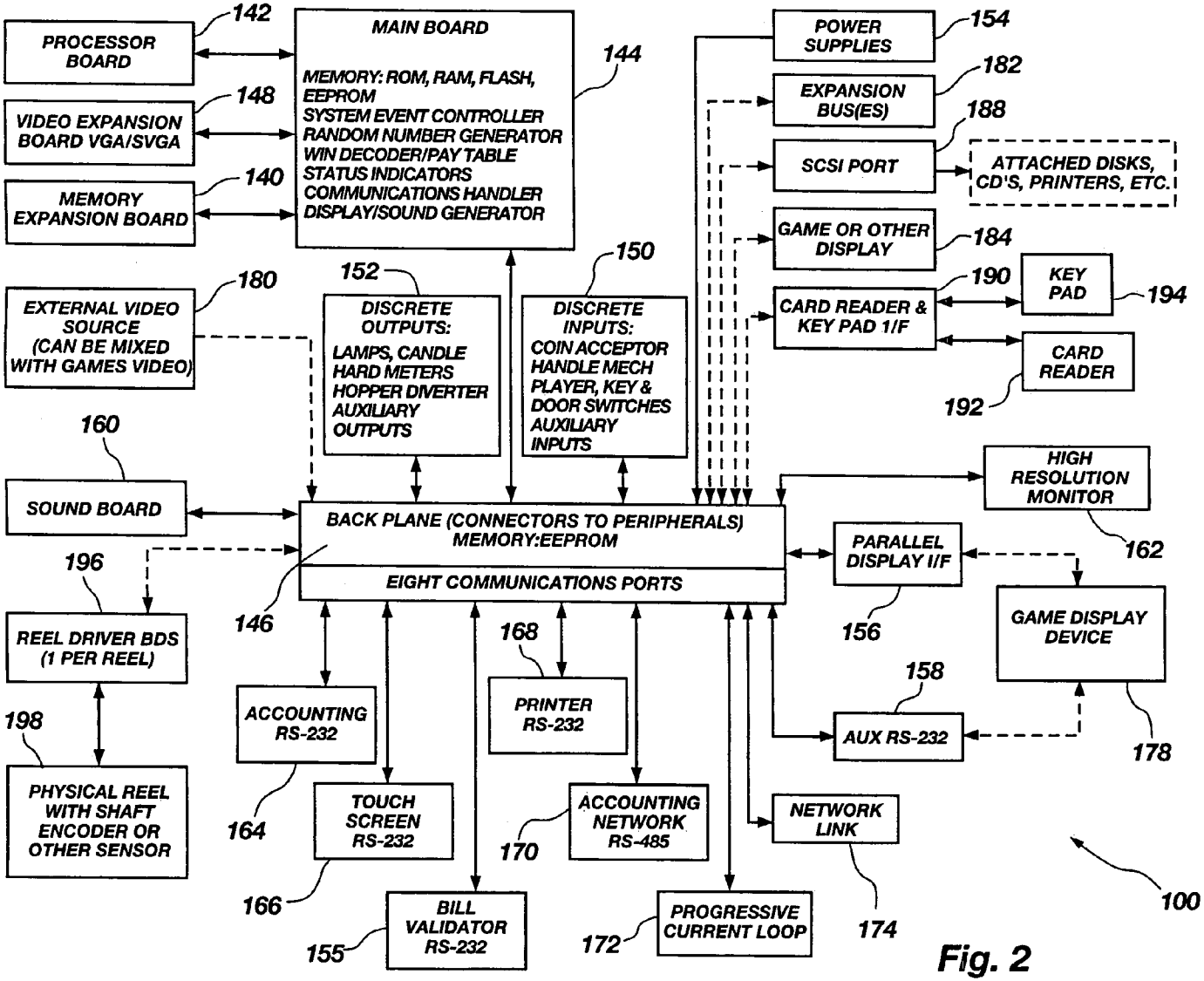
FIG. 2 is a schematic of one embodiment of a gaming machine which may be used to implement the present invention.

Referring now to FIG. 2, there is shown a schematic diagram of an exemplary gaming device or machine 100 which may be used to implement the present invention. The gaming device 100 disclosed herein is for exemplary purposes only. It will be appreciated to those of ordinary skill in the art that other gaming devices which perform functions the same as, or similar to, the gaming device 100 described herein are also encompassed within the present invention.

In use and operation, and referring to FIG. 2, gaming machine or device 100 includes a memory expansion board 140, a processor board 142, a main board 144 and a back plane 146 integrally or separately formed. Memory expansion board 140 as well as processor board 142, including a graphics system processor and video expansion board VGA/SVGA 148, are operably coupled to the main board 144. The main board 144 preferably includes memory in the form of ROM, RAM, flash memory and EEPROM (electrically erasable programmable read only memory). In addition, the main board 144 includes a system event controller, a random number generator, a win decoder/pay table, status indicators, a communications handler and a display/sound generator.

The main board 144 is operably coupled to the back plane 146, which may include additional memory, such as in the form of an EEPROM, and connectors to connect to peripherals. Furthermore, the back plane 146 provides a plurality of communication ports for communicating with external peripherals. The back plane 146 provides the coupling between discrete inputs 150 and the processor board 142 and main board 144. Typical examples of elements which provide discrete inputs 150 are coin acceptors, game buttons, mechanical hand levers, key and door switches and other auxiliary inputs. Furthermore, the back plane 146 provides the coupling between discrete outputs 152 and the processor board 142 and main board 144. Typically and by way of example only, elements that provide discrete outputs 152 are in the form of lamps, hard meters, hoppers, diverters and other auxiliary outputs.

The back plane 146 also provides connectors for at least one power supply 154 for supplying power for the processor board 142 and a parallel display interface (PDI) 156 and a serial interface 158 for game display device 178. In addition, the back plane 146 also provides connectors for a sound board 160 and a high-resolution monitor 162. Furthermore, the back plane 146 includes communication ports for operably coupling and communicating with an accounting interface 164, a touch screen 166 (which may also serve as a game display device), a bill validator 155 incorporated in a currency (bill) acceptor, a printer 168, an accounting network interface 170, a progressive current loop 172 and a network link 174.

The back plane 146 optionally includes connectors for external video sources 180, expansion buses 182, game or other displays 184, an SCSI port 188 and an interface 190 for at least one card reader 192 (debit/credit, player card, etc.) and key pad 194. The back plane 146 may also include means for coupling a plurality of reel driver boards 196 (one per reel) which drive physical game reels 198 with a shaft encoder or other sensor means to the processor board 142 and main board 144 if a gaming device 100 is configured for play of a reel-type game. Of course, the reels may be similarly implemented electronically by display as video images, technology for such an approach being well known and widely employed in the art. In such an instance, reel driver boards 196 and physical game reels 198 with associated hardware are eliminated and the game outcome generated by the random number generator on main board 144 is directly displayed on a video game display 184 and, optionally, on a separate game display device 178, as known in the art. It is currently preferred that the gaming activity of the present invention be implemented using a video display, as such approach facilitates the play sequence thereof. It will also be understood and appreciated by those of ordinary skill in the art that selected components of gaming device 100 may be duplicated for play of a bonus game or event in accordance with the present invention, in that at least a separate board with a second random number generator may be employed, with associated peripherals and links thereto, for play of the bonus game. In the conventional situation wherein the game of the present invention may be implemented and operably coupled as a "top box" or otherwise associated with a conventional, existing gaming machine configured for play of a base game, many of the components illustrated in FIG. 2 and described with respect thereto will be duplicated, including separate software and associated memory for conducting play of the bonus game with associated pay tables for the bonus awards.

Figure 3:
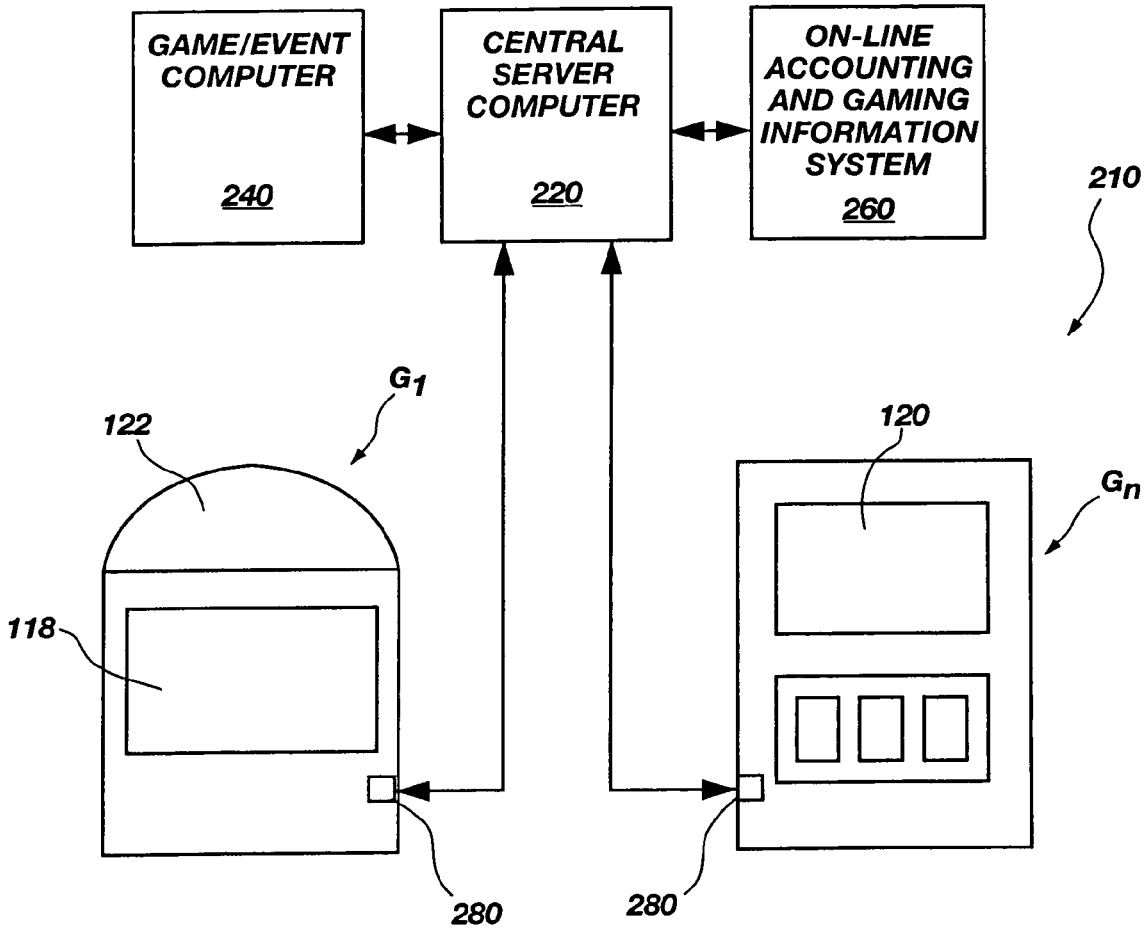
FIG. 3 is a schematic of how gaming machines used to implement the present invention may be networked together.

In implementation of the present invention, gaming machines offering play of the gaming activity of the present invention as a bonus game may be deployed, as schematically depicted in FIG. 3, in a gaming network 210 that includes a central server computer 220 operably coupled to a plurality of gaming machine $G_1$, $G_2$ . . . $G_n$, which may include both electronic and reel type game machines. It is notable that, unless the gaming network 210 is configured for progressive play, a variety of different makes of gaming machines $G_1$, $G_2$ . . . $G_n$ offering widely different games may incorporated in gaming network 210, since the bonus event operates independently of the primary game on each gaming. The central server computer 220 automatically interacts with a plurality of gaming machines $G_1$, $G_2$ . . . $G_n$ to activate a bonus event.

More specifically, and again referring to FIGS. 2 and 3, the gaming network 210 includes a central server computer 220, a bonus event computer 240 and a bank 214 or other plurality of gaming machines $G_1$, $G_2$ . . . $G_n$. Each gaming machine $G_1$, $G_2$ . . . . $G_n$ includes a controller assembly 280 operably coupled to the central server computer 220 and which is comprised of a controller unit designed to facilitate transmission of signals from each individual gaming machine $G_1$, $G_2$ . . . $G_n$ to central server computer 220. In addition, the controller assembly 280 includes a network interface board fitted with appropriate electronics for each specific make and model of each individual gaming machine $G_1, G_2 \ldots G_n$.

Referring to FIG. 3, in electronic video games, the central server computer 220 is operably coupled to at least one video game display element 118, as shown at the left hand side of FIG. 3, and sequesters a portion of the video game display element 118 for displaying video attract sequences to attract potential players. Video game display element 118 may be used for display of both the primary and bonus games. Where the gaming network 210 includes reel-type game machines $G_1, G_2 \ldots G_n$, as shown at the right hand side of FIG. 3, the central server computer 220 may be operably coupled to at least one active display element 120 so that potential players receive a clear indication of attract sequences and the active display element 120 may be used as a video display for the bonus game. As shown at the left hand side of FIG. 3, the gaming machines $G_1, G_2 \ldots G_n$ may also be provided with a second video display element 122 as an alternative to sequestering a portion of the video game display element 118 for displaying video attract sequences and the bonus game. In addition, the central server computer 220 may include sound-generating hardware and software for producing attractive sounds orchestrated with the video attract sequences at each of gaming machines $G_1, G_2 \ldots G_n$ if such is not already incorporated therein. The games support input and output between the player and the games for such devices as heads-up display, joystick, keyboard, mouse and data glove via interface modules connected through the expansion bus or buses 182 and SCSI port 188.

The attractive multimedia video displays and dynamic sounds may be provided by the central server computer 220 by using multimedia extensions to allow gaming machines $G_1, G_2 \ldots G_n$ to display full-motion video animation with sound to attract players to the machines. During idle periods, the gaming machines $G_1, G_2 \ldots G_n$ preferably display a sequence of attraction messages in sight and sound. The videos may also be used to market specific areas of the casino and may be customized to any informational needs.

Furthermore, the gaming network 210 includes bonus event computer 240 operably coupled to the central server computer 220 for scheduling bonus parameters such as the type of bonus game, pay tables and players. The functions of central server computer 220 and bonus event computer 240 may, of course, be combined in a single computer. Preferably, the gaming network 210 further includes a real-time or on-line accounting and gaming information system 260 operably coupled to the central server computer 220. The accounting and gaming information system 260 includes a player database for storing player profiles, a player tracking module for tracking players and a pit, cage and credit system for providing automated casino transactions.

Figure 4:
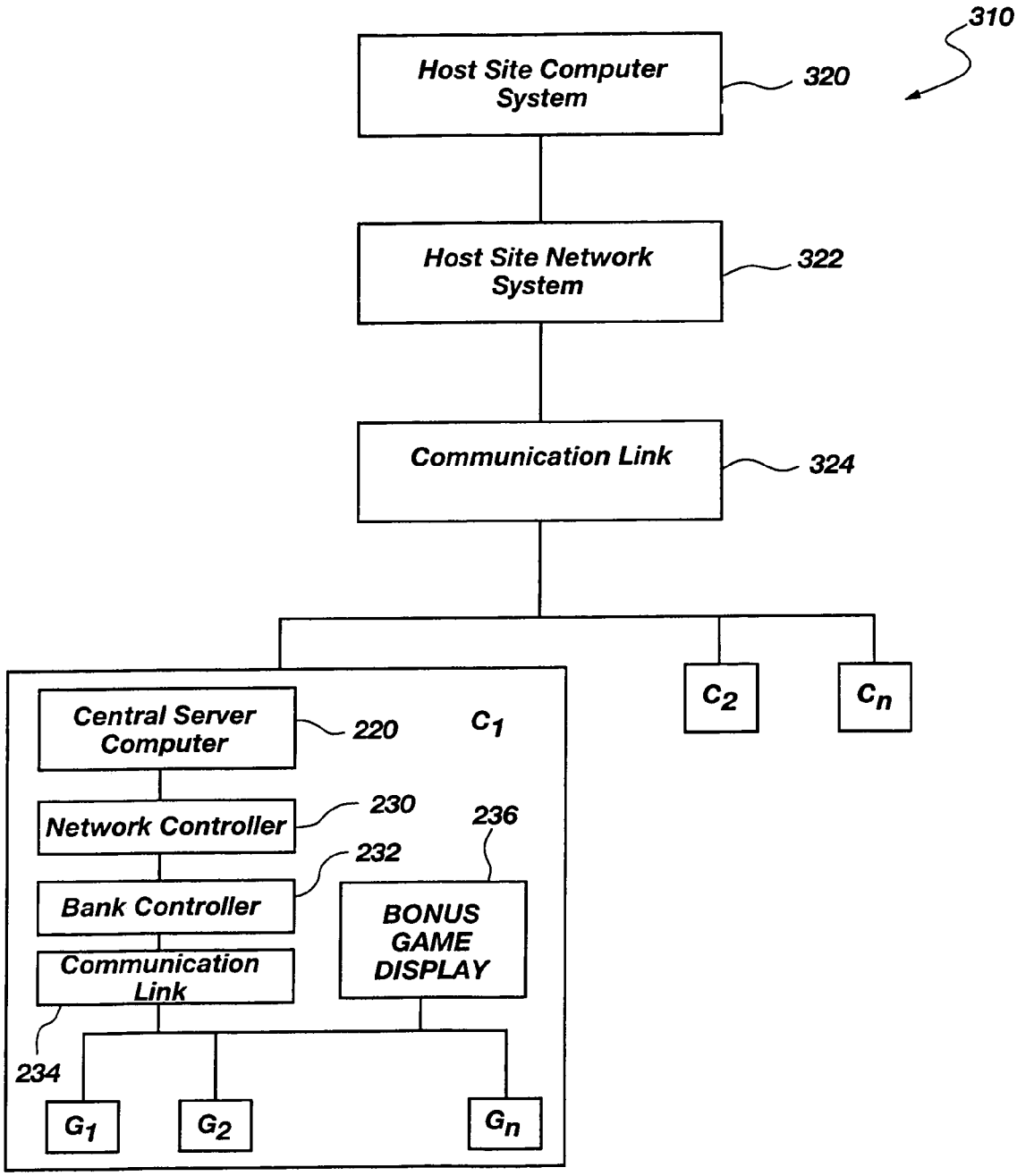
FIG. 4 is a schematic of a gaming system used with the present invention.

As previously implied, a bank of gaming machines $G_1, G_2 \ldots G_n$ may be networked together in a progressive configuration, as known in the art, wherein a portion of each wager to initiate a primary game may be allocated to bonus event awards. In addition, and referring to FIG. 4, a host site computer 320 is coupled to a plurality of the central server computers 220 at a variety of mutually remote casinos or other gaming sites $C_1, C_2 \ldots C_n$ for providing a multi-site linked progressive automated bonus gaming system 310.

Preferably, the host site computer 320 will be maintained for the overall operation and control of the system 310. The host site computer 320 includes a host site computer network 322 and a communication link 324 provided with a high-speed, secure modem link for each individual casino site $C_1, C_2 \ldots C_n$.

Each casino or other gaming site $C_1, C_2 \ldots C_n$ includes the central server computer 220 provided with a network controller 230 which includes a high-speed modem operably coupled thereto. Bidirectional communication between the host site computer 320 and each casino site central server computer 220 is accomplished by the set of modems transferring data over communication link 324.

A network controller 230, a bank controller 232 and a communication link 234 are interposed between each central server computer 220 and the plurality of networked gaming machines $G_1, G_2 \ldots G_n$ at each casino site $C_1, C_2 \ldots C_n$. In addition, the network controller 230, the bank controller 232 and the communication link 234 may optionally be interposed between each central server 220 and at least one separate bonus game display 236 at each casino site $C_1, C_2 \ldots C_n$. However, the system 310 may include hardware and software to loop back data for in-machine meter displays to communicate with bonus event award insert areas on gaming machines $G_1, G_2 \ldots G_n$.

Bonus game display 236 may be configured as a relatively large, liquid crystal display ("LCD") screen or a plurality of such screens. The screen(s) is/are relatively large in comparison to the high resolution monitor 162 or other game display device 178 of gaming machine 100. The bonus game display(s) 236 may be positioned in an area above the gaming machines $G_1, G_2 \ldots G_n$ so that the screen(s) is/are visible to all players at the bank 214 of gaming machines $G_1, G_2 \ldots G_n$. Bonus game display 236 may comprise other types of display screens known in the art including cathode ray tube (CRT) screens, plasma display screens, and/or screens based on light-emitting diode (LED) technology. Bonus game display 236 may be a display screen configured for multiple uses and/or concurrent display of other casino-sponsored information. For example, bonus game display 236 may be used in association with a Sports Book venue of the casino during periods in which bonus game display 236 is temporarily not used for the purposes of the present invention.

Gaming machines $G_1, G_2 \ldots G_n$ may be connected to bonus game display 236 through communication link 234. Communication link 234 may be any of a variety of communication links known in the art, including, but not limited to: twisted-pair wire, coaxial cable, fiber optic, Ethernet, token ring, bus line, Fibre Channel, ATM, standard serial connections, LAN, WAN, Intranet, Internet, radio waves, or other wireless connections.

It will be appreciated that in another embodiment, the gaming machines $G_1, G_2 \ldots G_n$ may be personal computers, computer workstations or other computer devices, known to those of ordinary skill in the art capable of networking to the system 310, located at sites remote from the host site computer 320. The personal computers may be located in homes, businesses or other locations remote from the host site computer 320. In this embodiment, the personal computers are configured such that the personal computer may connect to host site computer 320 through a network, such as one including the Internet. The personal computers are enabled to participate in gaming activities by downloading executable software programs, wherein the software programs provide access to the gaming activities on the host site computer 320. The games are conducted and controlled from the host site computer 320.

Figure 5:
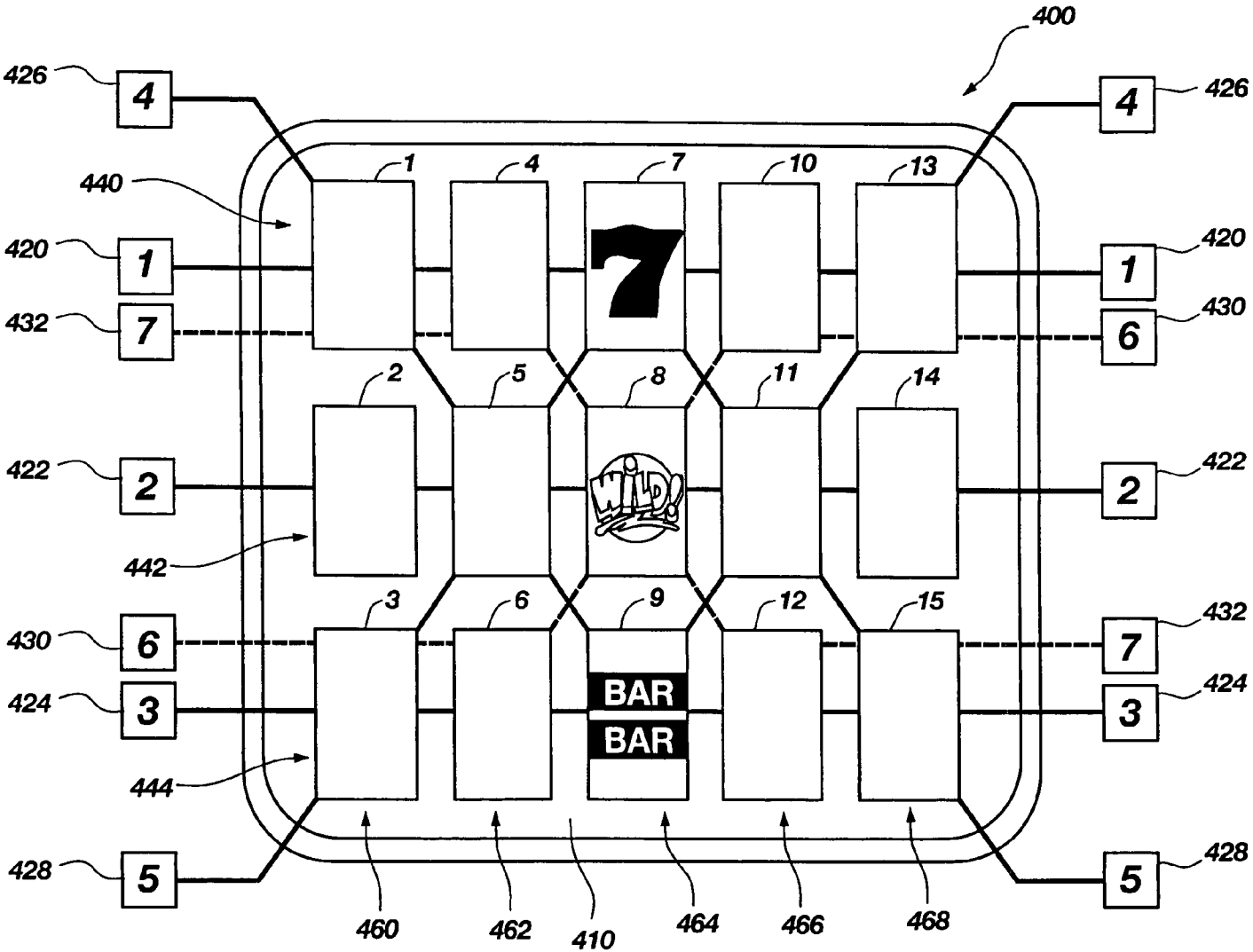
FIG. 5 is an exemplary video display of one embodiment of the gaming activity of the present invention showing one possible configuration of windows and pay lines and a display of a partial outcome.

It will be appreciated by those of ordinary skill in the art that the technology of the gaming devices and networks described herein may be configured to conduct the gaming activities of the present invention. The present invention encompasses an improved method of playing a slot machine game and a casino gaming machine configured for playing the same. Referring now to FIG. 5, there is shown an illustrated embodiment of the method of playing a partial outcome slot machine game on a gaming machine. In the illustrated embodiment of the present invention, the gaming machine is an electronic slot machine 400, only a display portion of which is depicted, the remainder of the apparatus comprising elements previously described with respect to FIGS. 2 and 3, including a suitably programmed microprocessor and attendant memory. The electronic slot machine 400 is configured for play of the partial outcome slot machine game of the present invention. The display of the slot machine 400 comprises a touch sensitive video display 410. In the illustrated embodiment, the touch sensitive video display 410 comprises five vertical columns, 460, 462, 464, 466 and 468, each column meant to simulate a gaming "reel" of a mechanical slot machine, and three horizontal rows 440, 442 and 444. The five columns and three horizontal rows provide a total of fifteen display windows 1-15. It will be appreciated by those of ordinary skill in the art that the method of playing the partial outcome slot machine game may also be played on a mechanical slot machine (not shown). If the mechanical slot machine is used, the five columns of the present embodiment would comprise five mechanical reels (not shown), wherein each reel would display three indicia (not shown) in the windows of the three rows. However, due to the extreme difficulty of implementing the present invention mechanically with reliability and at a reasonable cost, it is currently preferred that the present invention be implemented electronically.

Referring again to FIG. 5, multiple pay lines are provided. The touch sensitive video display 410 of the illustrated embodiment comprises seven pay lines. The first pay line 420 is the horizontal top row 440 comprising windows 1, 4, 7, 10 and 13. The second pay line 422 is the horizontal middle row 442 comprising windows 2, 5, 8, 11 and 14. The third pay line 424 is the horizontal bottom row 444 comprising windows 3, 6, 9, 12 and 15. The fourth pay line 426 is a zig-zag line comprising windows 1, 5, 7, 11 and 13. The fifth pay line 428 is a zig-zag line comprising windows 3, 5, 9, 11 and 15. The sixth pay line 430 is a diagonal comprising windows 3, 6, 8, 10 and 13. The seventh pay line 432 is a diagonal comprising windows 1, 4, 8, 12 and 15.

Play of the slot machine game in the illustrated embodiment is initiated by placing a wager in the slot machine 400. The wager may be made by placing cash, such as a coin or bill into the slot machine 400, by using a card reader to read credits from a player card or by any other manner of placing a wager in gaming devices known to those of ordinary skill in the art. After placing the wager, play of the game begins by the slot machine 400 generating a partial outcome of the slot machine game. As used herein, the term "partial outcome" is meant to refer to a partial result of a slot machine game, wherein at least one window, but fewer than all of the windows, displays an indicia. The partial outcome and final outcome are generated by the random selection of one indicia for each window by the microprocessor of main board 144 (FIG. 2) from a plurality of available indicia. It will be appreciated that the random selection of indicia for display in slot machine games is well known to those of ordinary skill in the art.

For example and referring to FIG. 5, the partial outcome is indicated by stopping a video "reel" represented by column 464 comprising vertically aligned windows 7, 8 and 9. The remaining "reels" 460, 462, 466 and 468 may continue to "spin" to the player viewing display 410 or otherwise not show any indicia. As shown in FIG. 5, the stopped reel 464 is showing indicia in windows 7 (a numeral "7"), 8 (a "WILD" symbol) and 9 (a "DOUBLE BAR" symbol). As used herein, the term "indicia" is meant to refer to any symbol, character or other element meant to convey a portion of the outcome, partial or final, randomly generated by a gaming device 100 and displayed in the windows 1 through 15, to the player. After the one "reel" 464 is stopped, the player views the indicia present in the windows, 7-9, then determines which of the seven pay lines, 420, 422, 424, 426, 428, 430 or 432, to select in an attempt to achieve a winning combination of indicia.

The pay line or pay lines selected by the player is determined based on the player's subjective strategy. For example, the player may determine which displayed indicia in reel 464 provides a higher probability of achieving a winning outcome, which indicia provides a higher potential reward based on a combination of indicia achievable on a pay line, which indicia may provide a possible progressive bonus award combination or which indicia may provide any perceived possible favorable combination based on any other factor employed in the game architecture in accordance with the player's subjective decision. It will be appreciated by those of ordinary skill in the art that the various indicia used in the slot machine 400, the probability of winning based on combinations of indicia and the payout schedule of each individual slot machine 400 depend on how each particular slot machine 400 is configured. For example, the indicia may contain a "WILD" symbol that substitutes for any indicia required to achieve a winning combination in the pay line, thus providing a higher probability of winning. Alternatively, the indicia may comprise a bonus symbol that provides a multiplier or other enhancing effect providing a larger sum of money that may be won, or any other indicia defining a winning known to those of ordinary skill in the art.

Figure 6:
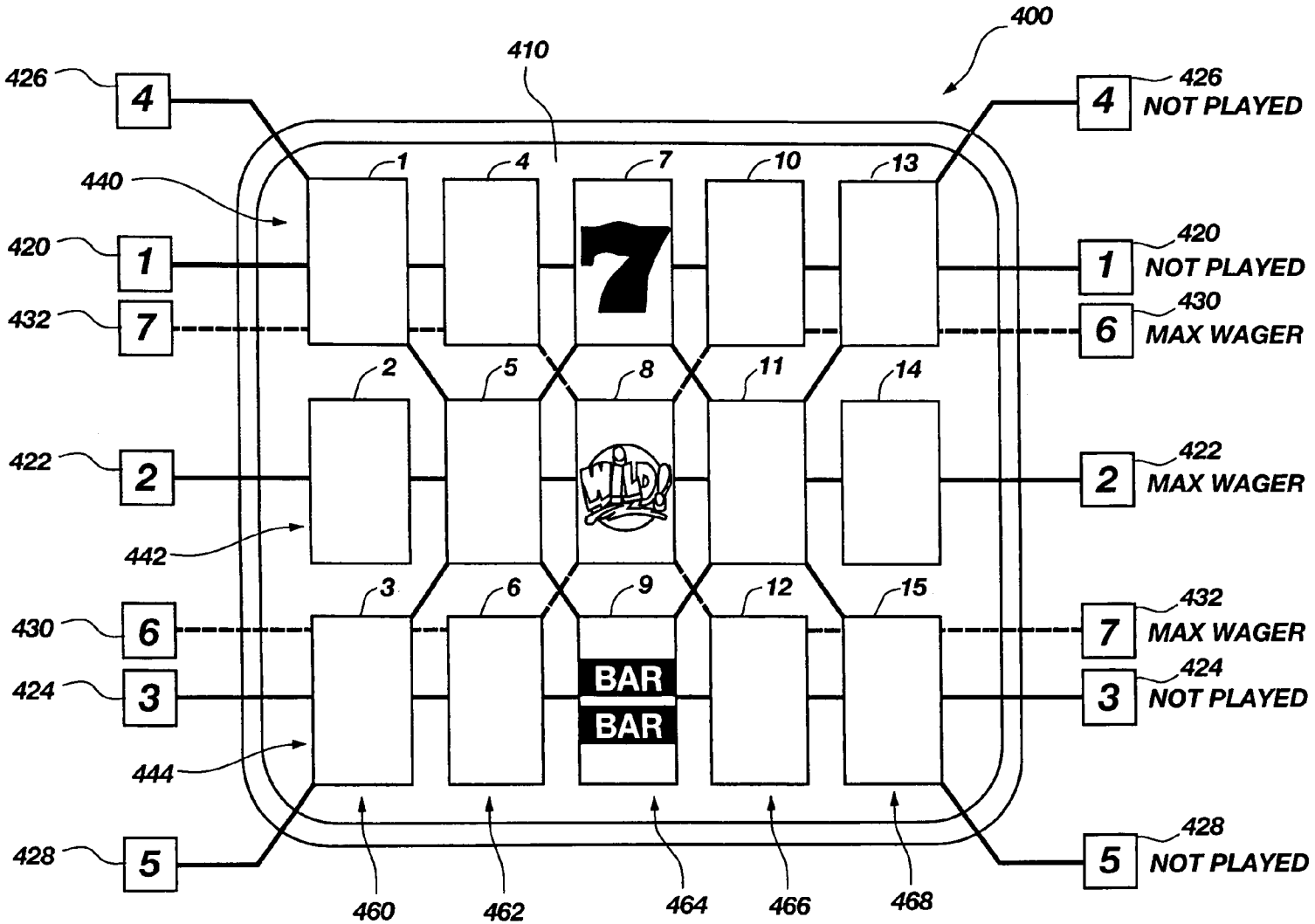
FIG. 6 is the exemplary video display of the embodiment shown in FIG. 5 showing the pay lines selected by a player.

In the illustrated embodiment and referring to FIG. 6, the "WILD" symbol in window 8 provides the player with a higher probability of obtaining a winning combination because the "WILD" symbol substitutes for any indicia required for obtaining a winning combination. Therefore, the player has selected or activated pay lines 430, 422 and 432 and placed a "maximum wager" on these pay lines 430, 422 and 432 because the pay lines 430, 422 and 432 run through the window 8, which contains the "WILD" indicia. In the illustrated embodiment, the player makes selections by simply touching the desired pay line on the touch sensitive video display 410. After the player has selected the pay lines 430, 422 and 432, the game is finished by stopping the remaining four "reels" 460, 462, 466 and 468 to provide the final outcome, wherein the random number generator on main board 144 (shown in FIG. 2) randomly selects the indicia to fill the remaining windows 1-6 and 10-15. The generation of the final outcome may be initiated by the player actively "stopping" the remaining four "reels" 460, 462, 466 and 468 by pushing a button, pulling a lever, touching a button on the touch sensitive video display 410 or in any other manner known to those of skill in the art. Of course, the game may be configured so that more than one "reel" stops to display a partial outcome, and the displayed reel or reels may be varied with each play of the game. It is also contemplated that a player may be enabled, prior or subsequent to placement of a wager, to designate the location or locations of one or more reels as permitted by the game architecture to display the partial outcome, or even scattered individual windows of a predetermined number on different reels, to enhance player interaction.

In an alternative embodiment, the gaming device 100 employed as slot machine 400 may be configured with a timer or use a clock function on main board 144, wherein the timer or clock function may be set such that the player has a predetermined amount of time after display of a partial game outcome to decide which pay line or lines to select. If the player does not select one or more pay lines within the time provided, the slot machine 400 may be configured to automatically select pay lines for the player, randomly or the pay lines with the highest probability of obtaining a winning combination, and finishes the game by displaying the final outcome. The timer or clock function provides a way to ensure a player does not take an inordinate amount of time in selecting pay lines and speeds up play of the game, ensuring that a casino owner is maximizing revenue.

Figure 7:
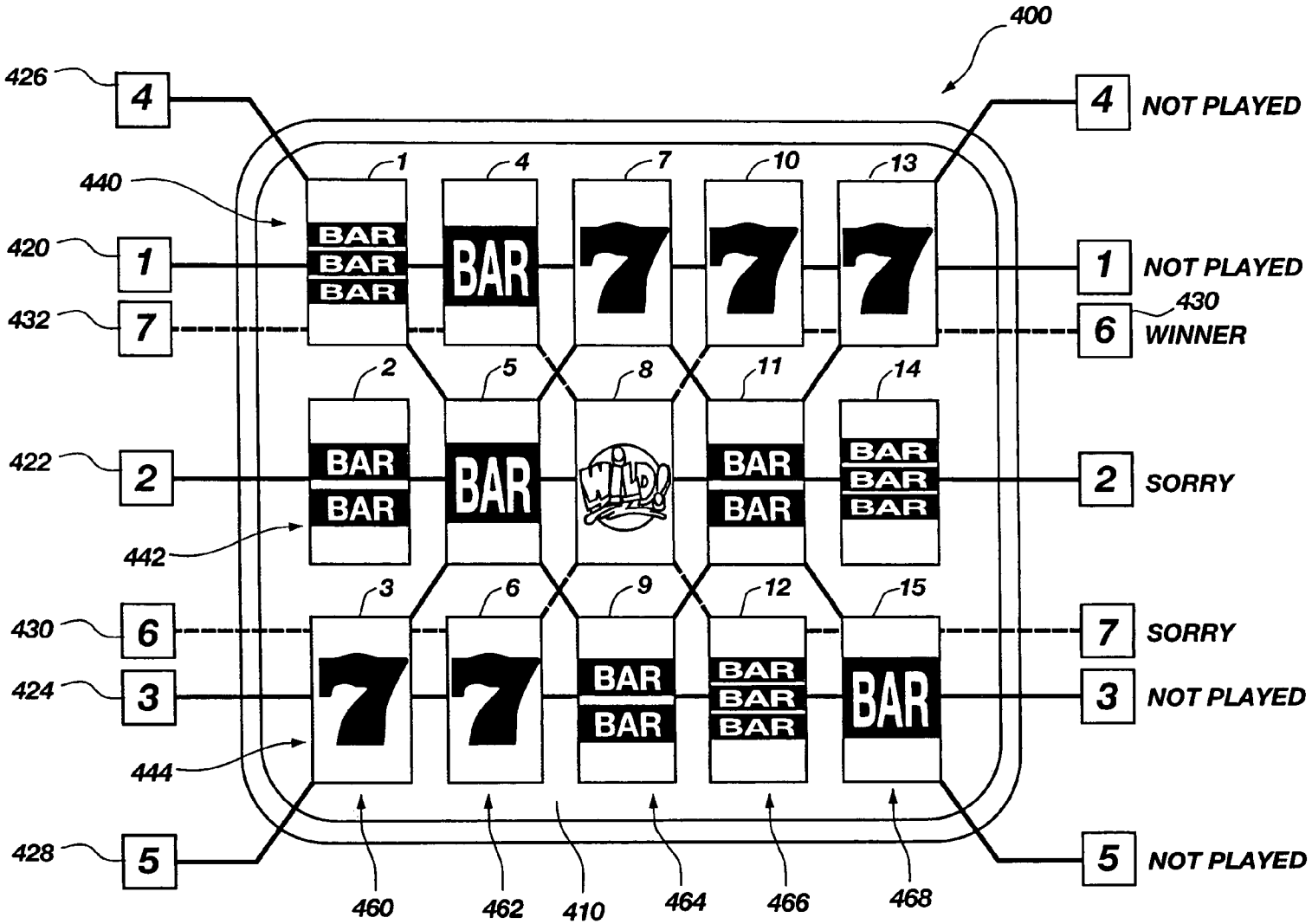
FIG. 7 is the exemplary video display of the embodiment shown in FIG. 5 depicting the final outcome of the gaming activity described in FIGS. 5 and 6.

Referring now to FIG. 7, there is shown the slot machine 400 after a final outcome has been generated by the slot machine 400. The five "reels," 460, 462, 464, 466 and 468, have all been stopped. The player has achieved a winning combination on pay line 430 by achieving the indicia "7" in windows 3, 6, 10 and 13, and the "WILD" indicia in window 8. Based on the outcome, the slot machine 400 would provide an appropriate payout to the player based on predetermined pay tables programmed within the slot machine 400.

Figure 8:
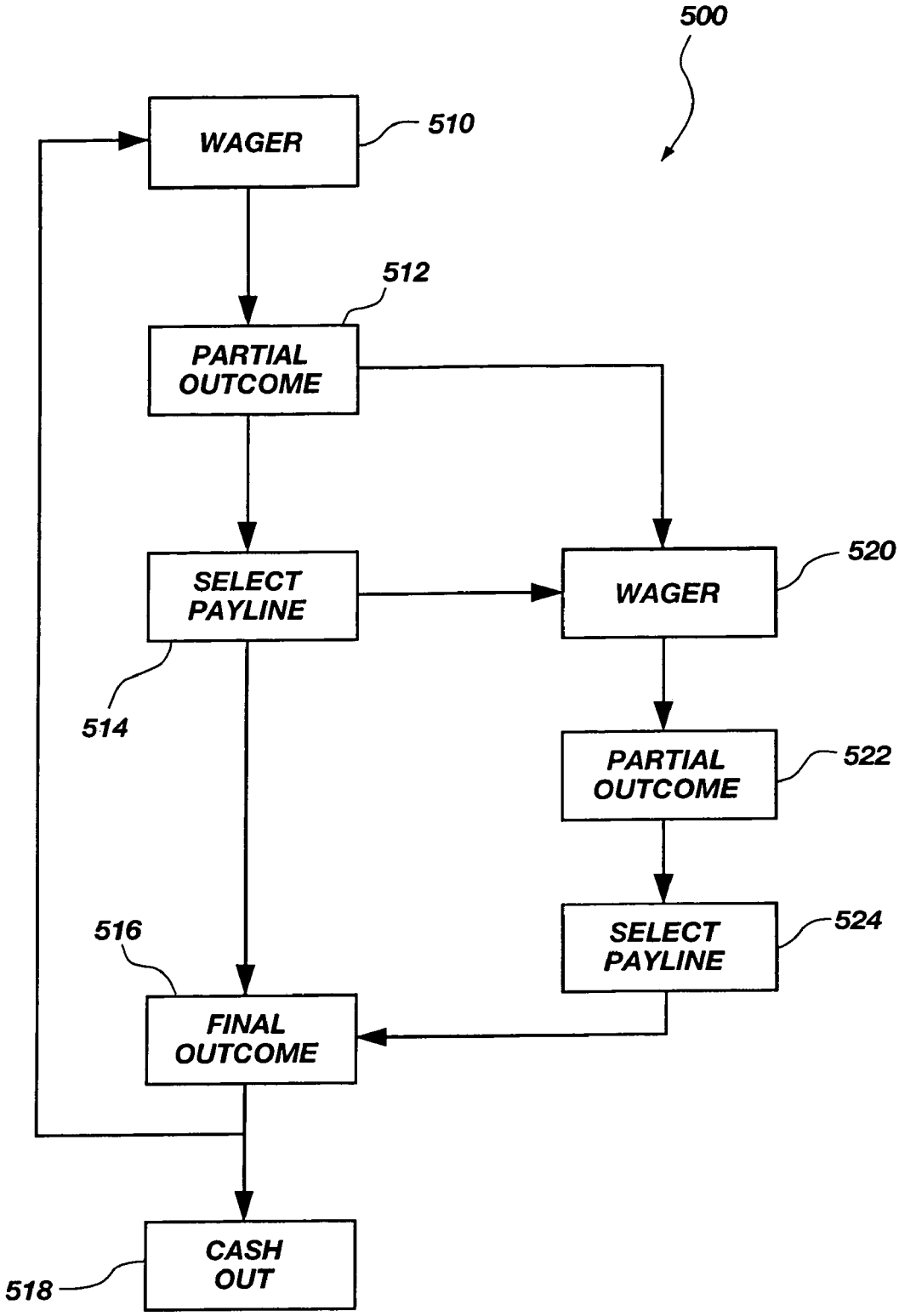
FIG. 8 is a flow chart diagramming play of the gaming activity of the present invention.

The method of playing the partial outcome slot machine game of the present invention includes many embodiments. Referring to FIG. 8, there is shown a flow chart 500 of a method of playing the partial outcome slot machine game. The sequence for playing the partial outcome slot machine game illustrated in FIG. 8 comprises placing a first wager 510, generating a first partial outcome 512, selecting at least one pay line 514, placing a second wager 520, generating a second partial outcome 522, selecting at least another pay line 524 and determining a final outcome 516. The player may then cash out 518. In the steps described above, the second partial outcome 522 comprises displaying more indicia in more windows in addition to those indicia which were shown in the first partial outcome 512. Also, if more than one opportunity is provided wherein the player selects at least one pay line, such as 514 and 524, the second pay line selection step 524 may be limited to selecting fewer pay lines than were selected in the first pay line selection step 514. It will be appreciated to those of ordinary skill in the art that the sequence described in the flowchart 500 may be modified in various embodiments of the partial outcome slot machine game described herein. In other, additional embodiments, the method of playing the partial outcome slot machine game may comprise multiple or single acts of placing wagers 510 and 520, multiple or single acts of generating partial outcomes 512 and 522 and multiple or single acts where pay lines are selected 514 and 524.

For example, the method of playing the partial outcome slot machine game described with reference to FIGS. 5-7 employs the following sequence: placing the first wager 510, generating the first partial outcome 512, selecting one or more pay lines 514 and determining the final outcome 516. A method of playing the partial outcome slot machine game comprising additional acts may comprise: placing the first wager 510, providing the first partial outcome 512, selecting at least two pay lines 514, placing the second wager 520, providing the second partial outcome 522, selecting a single pay line 524, and generating a final outcome 516.

Figure 9A:
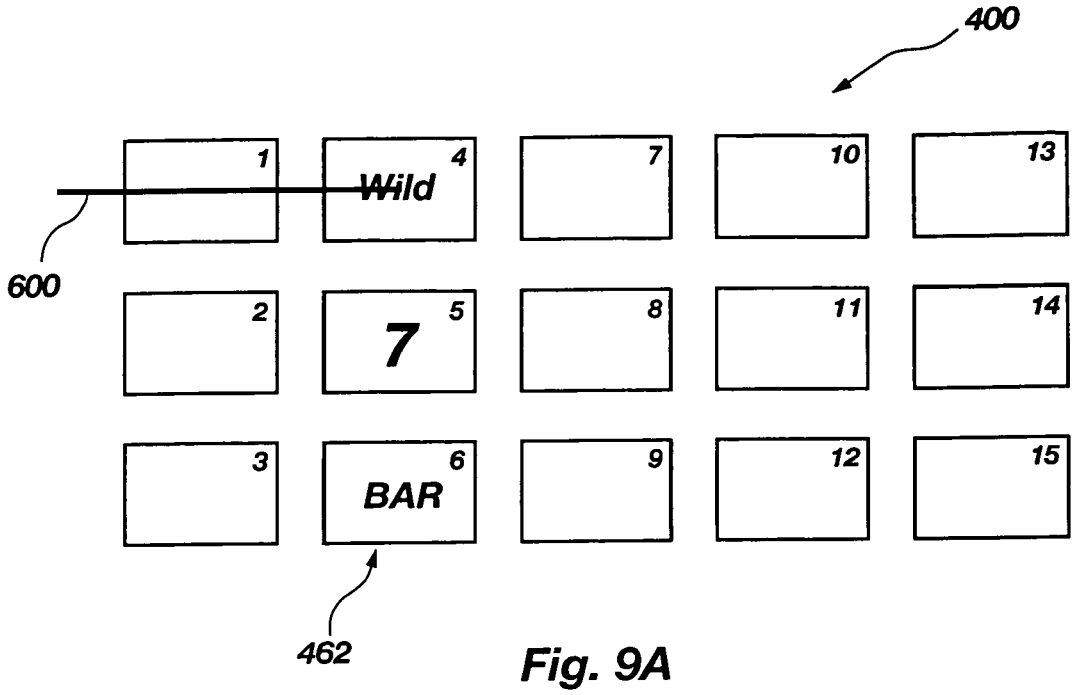
FIG. 9A and FIG. 9B show another exemplary embodiment of the gaming activity of the present invention where the player sequentially selects windows to form a pay line.
Figure 9B:
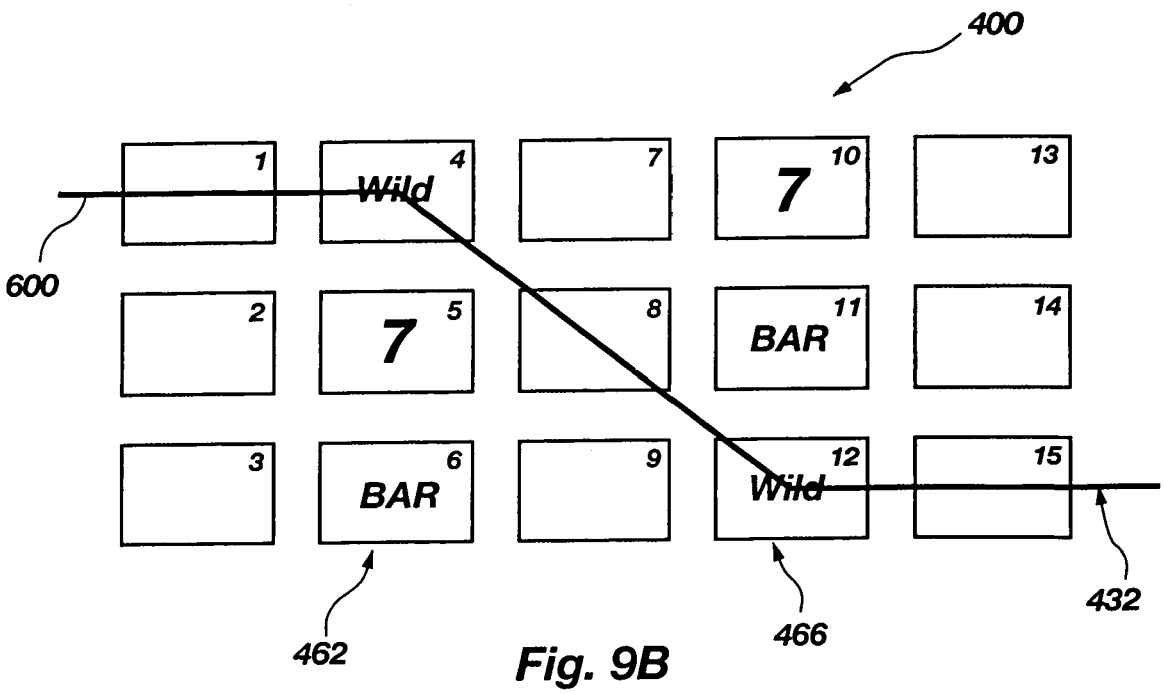

The acts of selecting the pay line 514 and 524 in the gaming activity of the present invention has many embodiments. For example and referring to FIGS. 9A and 9B, there is shown a first embodiment of selecting the pay lines wherein the player sequentially selects the pay lines. The sequential selection of the pay lines is illustrated in an example where the first partial outcome is indicated by the stopped "reel" 462. In this embodiment, the player sequentially selects windows to generate the pay lines to be activated. In the illustrated example, the player has selected windows 1 and 4, indicated by a solid line 600, after seeing the first partial outcome. Windows 1 and 4 are sequentially included in pay line 420 comprising windows 1, 4, 7, 10 and 13 (shown in FIG. 5) and pay line 432 comprising windows 1, 4, 8, 12 and 15 (shown in FIG. 5). The selection of pay lines 420 and 432 provides the player a higher probability of achieving a winning combination than the selection of the other pay lines because the "WILD" symbol is present in window 4. Referring now to FIG. 9B, the second partial outcome is shown by stopping "reel" 466. Based on the indicia shown on "reel" 466, the player has selected windows 8, 12 and 15 which comprise the pay line 432, indicated by the solid dark line 600, wherein the player will have two "WILD" indicia included in the pay line 432. After the player has sequentially selected the windows 1, 4, 8, 12 and 15 in the pay line 432, the final outcome is generated and the slot machine 400 determines if the player has achieved a winning combination. Sequentially allowing the player to select the pay line adds excitement to the game as the game gradually builds to a conclusion or final outcome, thus keeping the player's interest.

Figure 10A:
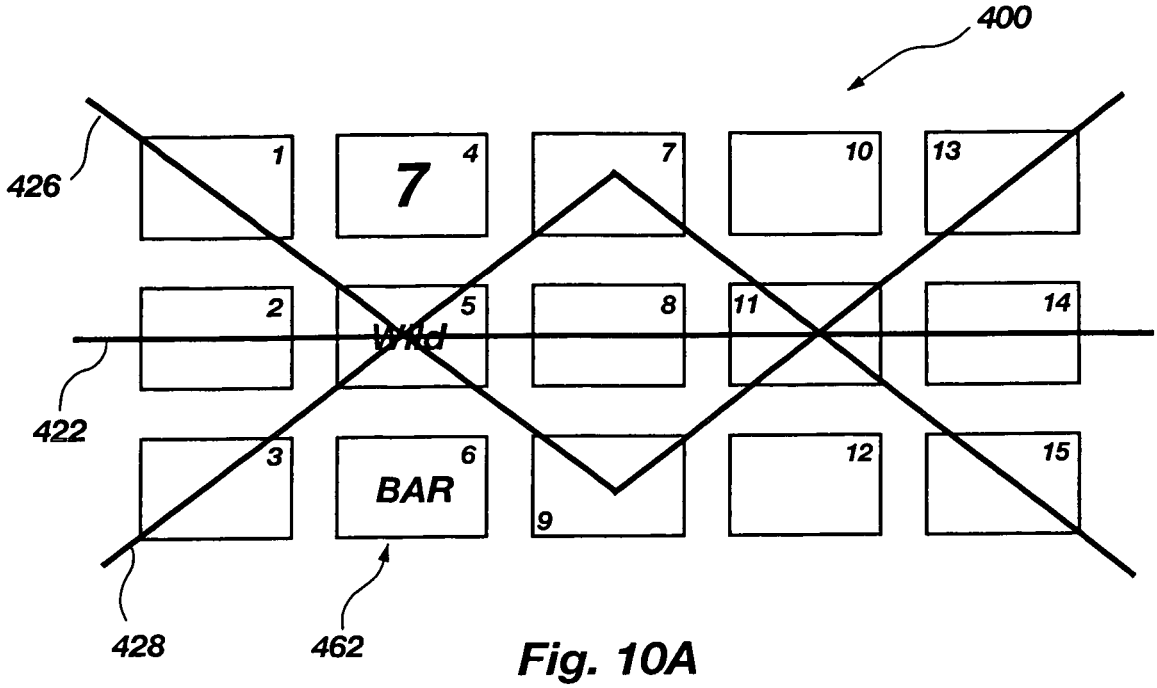
FIG. 10A and FIG. 10B show another exemplary embodiment of the gaming activity of the present invention where the player selects a plurality of pay lines.
Figure 10B:
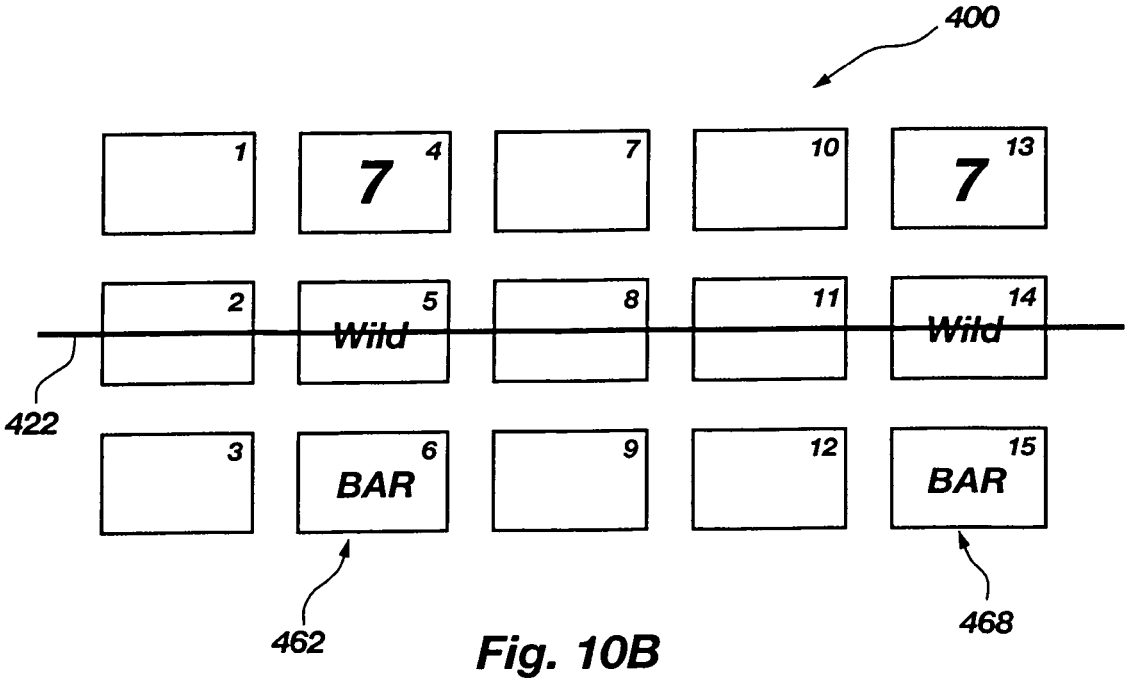

In a second embodiment of selecting the pay lines, the player may initially select multiple pay lines based on the first partial outcome, then select a single pay line based on the second partial outcome. For example and referring to FIG. 10A, the first partial outcome is shown by stopping the "reel" 462. Based on the "WILD" indicia in window 5 generated by the first partial outcome, the player has selected the following three pay lines: pay line 422 comprising windows 2, 5, 8, 11 and 14; pay line 426 comprising windows 1, 5, 9, 11 and 13; and pay line 428 comprising windows 3, 5, 7, 11 and 15. The player may place the second wager to receive the second partial outcome and select one pay line based on the second partial outcome. Referring now to FIG. 10B, the second partial outcome is indicated by stopping the "reel" 468. Based on the "WILD" indicia in window 14, the player may eliminate two pay lines and select the pay line 422 for a higher probability of achieving a winning combination because two "WILD" indicia are present in windows 5 and 14 of pay line 422. The final outcome is generated and the player is paid in accordance with a predetermined pay table if a winning combination is achieved.

Figure 11A:
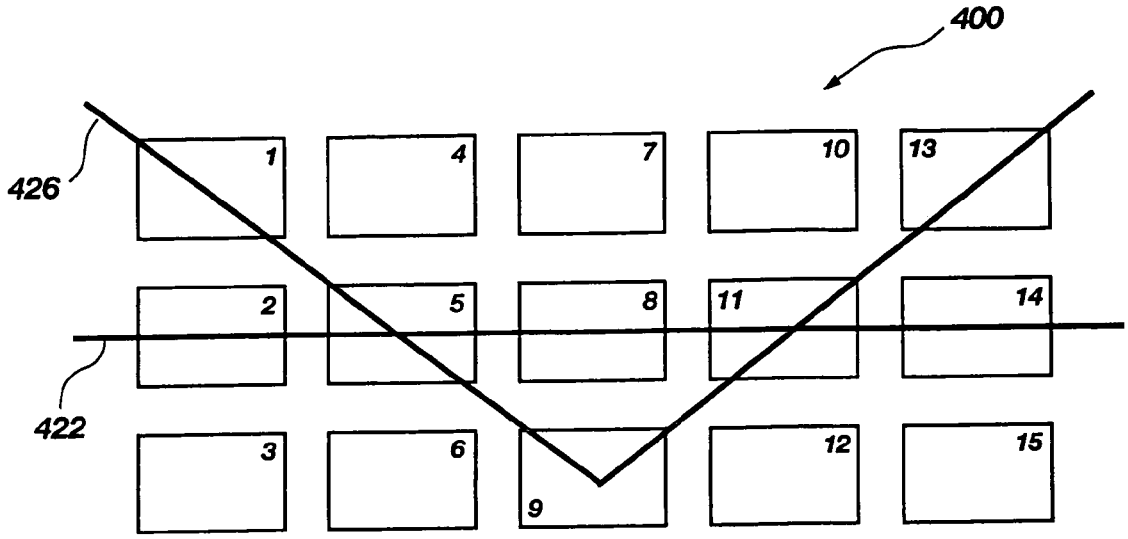
FIG. 11A and FIG. 11B show another exemplary embodiment of the gaming activity of the present invention where the player selects both the pay lines and the partial outcome.
Figure 11B:
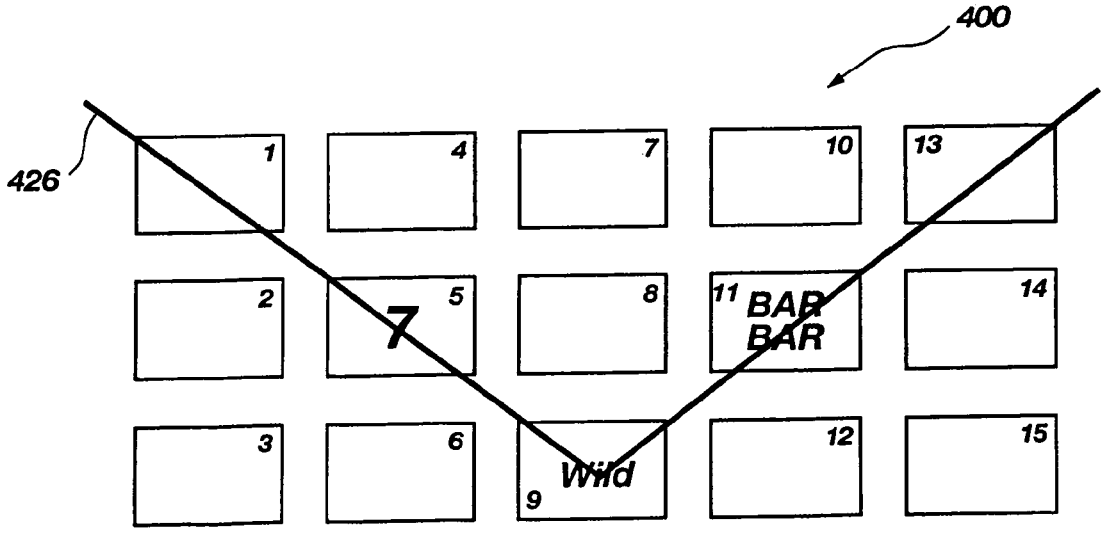

In a third embodiment of selecting the pay lines, the player selects the pay line and the windows for display of the partial outcome. Referring to FIG. 1A, the player has placed the first wager and selected pay line 426 comprising windows 1, 5, 9, 11 and 13 and pay line 422 comprising windows 2, 5, 8, 11 and 14. In this embodiment, the player may, for example, select any three windows to display the partial outcome that will be generated by the slot machine 400. Referring to FIG. 11B, the player has strategically selected windows 5, 9 and 11 to display the partial outcome because two of these windows, 5 and 11, are found in both the pay lines 426 and 422 selected by the player. The player selects the three windows, 5, 9 and 11, by touching the windows 5, 9, and 11 on the touch sensitive video display 410. The player's selection allows the player to view the partial outcome of two windows 5 and 11 present in each pay line 422 and 426. The partial outcome shows a "WILD" symbol in window 9, indicating that a greater probability of achieving a winning combination is present in pay line 426 instead of pay line 422 because pay line 422 does not contain the "WILD" symbol. The player may place the second wager, select the single pay line 426 and achieve the final outcome of the game. The player is paid in accordance with the predetermined pay table if a winning combination is achieved.

Figure 12:
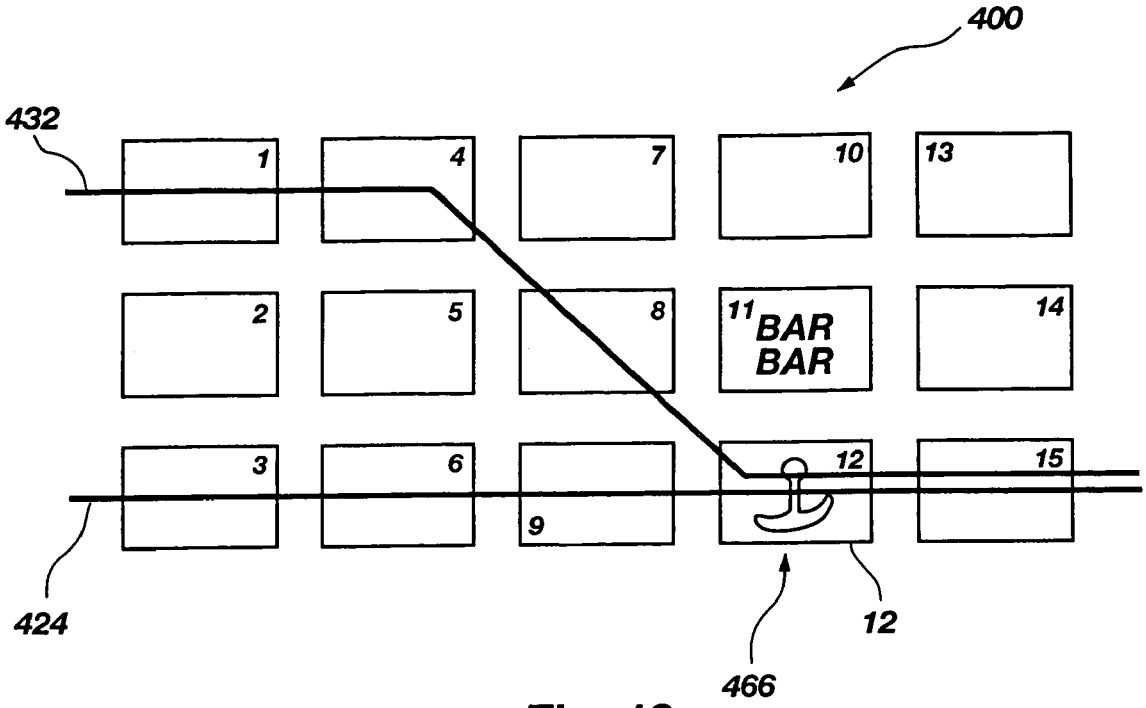
FIG. 12 shows another embodiment of the gaming activity of the present invention depicting a selection of pay lines which pass through specified indicia.

In a fourth embodiment of selecting the pay lines, the player has the option of selecting all the pay lines that pass through a window containing a specified indicia. For example and referring to FIG. 12, the first partial outcome has been generated by the slot machine 400 stopping the "reel" in column 466. Based on the first partial outcome, the player has selected the pay lines 432 and 424 which pass through the indicia required to win the progressive bonus award, an anchor, displayed in window 12. Depending on the configuration of the slot machine 400, a second partial outcome may be generated or the final outcome may be generated to finish the partial outcome slot machine game.

As appreciated by those of ordinary skill in the art, the illustrated embodiments are only a few examples of a plurality of possible methods of playing the partial outcome slot machine game encompassed by the present invention. The total number of partial outcome games possible varies depending on how the slot machine 400 is configured. The number of columns or "reels" used in the gaming machine, the number of rows displayed on each "reel," the number of "reels" stopped or windows selected to provide a partial outcome, the method by which the "reels" are stopped (sequentially or simultaneously) and the number of wagers made before the final outcome is generated may all be varied to determine the total number of partial outcome games and game segments possible for each slot machine. Additionally, if more than one partial outcome is generated per game, then a minimum bet may be required before one or more "reels" are stopped to generate each partial outcome. Providing multiple partial outcomes increases the complexity of the game wherein a player may reanalyze his or her strategy upon generation of each partial outcome.

Additionally, the gaming machines of the present invention may be configured such that a single gaming machine provides a plurality of possible games for a player to select to play. When play of the gaming activity is initiated, the player may choose one of the plurality of games to fit the player's preferences. For example, the different partial outcome slot machine games embodied in FIGS. 5-12 may all be played on the same slot machine 400. Before or after the player deposits money or decrements credits in the slot machine 400, the player may have the option of selecting which gaming activity to play.

Figure 13A:
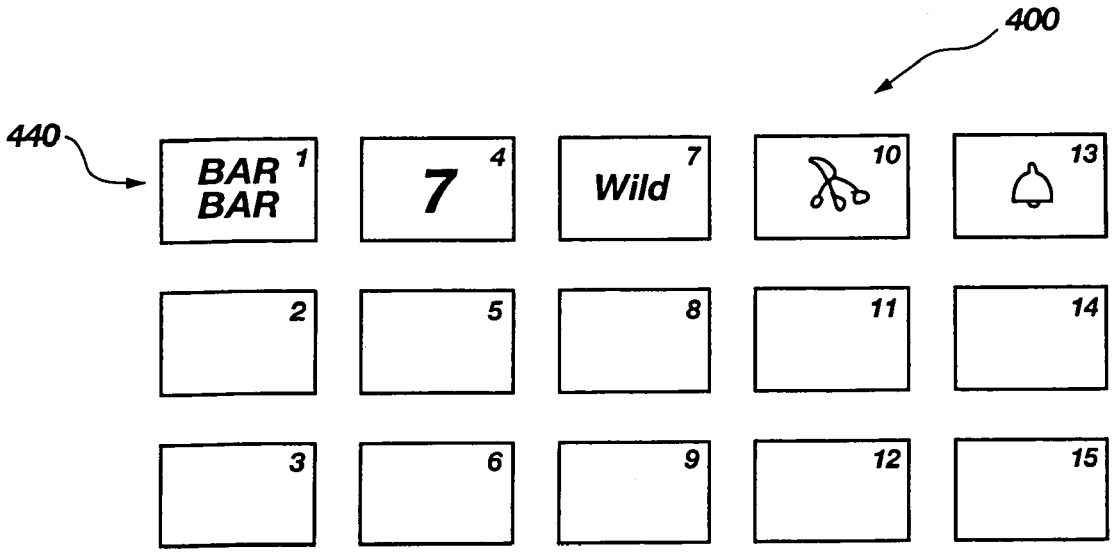
FIG. 13A shows another embodiment depicting a row of windows as the partial outcome.
Figure 13B:
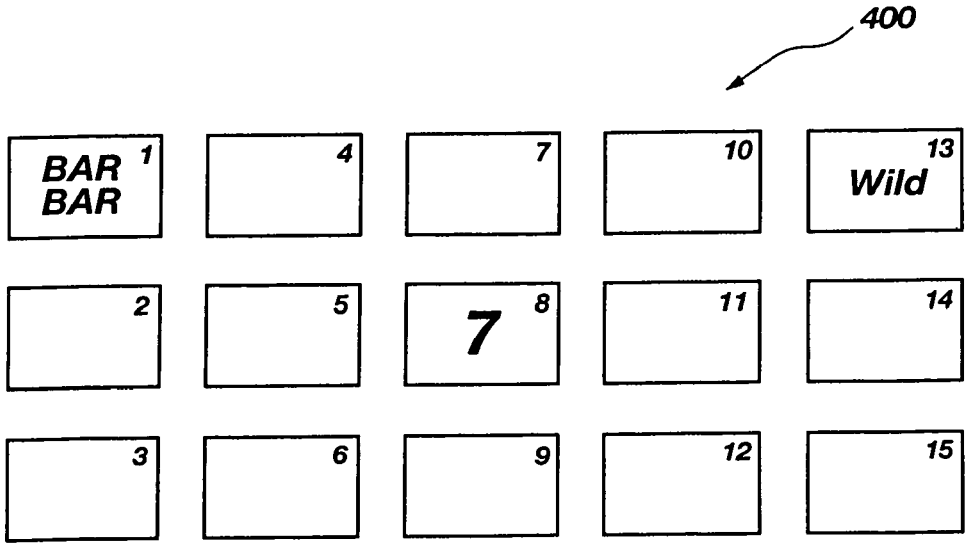
FIG. 13B shows another embodiment depicting a random generation of windows for the partial outcome.

As noted above, it will be appreciated by those of ordinary skill in the art that the embodiments of the present invention may be played on a mechanical reel slot machine or an electronic-type slot machine. The electronic-type slot machine provides greater flexibility in customizing each gaming machine. For example, instead of the partial outcome comprising stopping a single column, or "reel", of indicia as illustrated in FIG. 5, a row or even a geometric or scattered pattern of windows may be used to provide a display of the partial outcome. Referring to FIG. 13A, there is shown a partial outcome generated by displaying indicia in a row 440 of windows 1, 4, 7, 10 and 13. Referring to FIG. 13B, there is shown a partial outcome generated by a random or scattered pattern of windows, wherein windows 1, 8 and 13 were randomly selected by the gaming machine 400 to contain indicia. Thus, the electronic slot machine device of the present invention provides nearly endless possibilities of different combinations and options for providing gaming activities.

It is further contemplated that additional or alternative partial outcome selections other than pay lines may be offered as part of the game architecture of the game of the present invention. For example, a player may be afforded one or more opportunities to choose a symbol on a reel, or on some or all of the reels, to be a "WILD" symbol at the time of display of a partial outcome to enhance the probabilities of a winning final outcome. Thus, one or more parameters other than, or in addition to, pay line selection may be altered to perceptibly enhance the potential for affecting the final outcome of the game.

Although the present invention has been shown and described with respect to preferred embodiments, various additions, deletions and modifications that are obvious to a person skilled in the art to which the invention pertains, even if not shown or specifically described herein, are deemed to lie within the scope of the invention as encompassed by the following claims.

What is claimed is:

1. A gaming apparatus comprising:

at least one display device having a separate symbol display area for each of a plurality of reels;

at least one input device;

at least one processor configured to operate with the at least one display device and at least one input device to:

(a) display the plurality of reels, each of the plurality of reels displaying a plurality of symbols;

(b) display a plurality of different pay lines associated with the plurality of reels, each of the pay lines including one location from each of the separate symbol display positions;

(c) before displaying any symbols which are generated for a play of a game, receive a wager for a designated quantity of the plurality of pay lines which will be evaluated for winning symbol combinations for the play of the game, said designated quantity being at least one and less than a number equal to all of the pay lines;

(d) before enabling a player to select one of the plurality of pay lines for at least one of the designated quantity of the plurality of pay lines which will be evaluated for winning symbol combinations for the play of the game, cause a first group of the plurality of reels to display symbols which are generated for the play of the game by the first group of reels, the first group of reels including at least one and less than all of the plurality of reels;

(e) after the symbols which are generated for the play of the game by the first group of reels are displayed and before causing a second group of the plurality of reels to display symbols which are generated for the play of the game by the second group of reels, the second group of reels including at least one and less than all of the plurality of reels, the second group of reels not including any of the reels of the first group, receive a selection of one of the plurality of pay lines for at least one of the designated quantity of the plurality of pay lines which will be evaluated for winning symbol combinations for the play of the game;

(f) after the selection of one of the plurality of pay lines for the at least one of the designated quantity of pay lines is received, cause the second group of reels to display symbols which are generated for the play of the game by the second group of reels; and (g) determine a pay out by evaluating each selected pay line for any winning symbol combinations.

2. The gaming apparatus of claim 1, wherein the least one processor is configured to operate with the at least one display device and at least one input device to receive a plurality of selections via the input device of one of the plurality of pay lines after the symbols which are generated for the play of the game by the first group of reels are displayed.

3. The gaming apparatus of claim 1, wherein the at least one input device comprises at least one of a coin acceptor, a bill acceptor, and a debit/credit/casino card reader.

4. The gaming apparatus of claim 1, wherein the at least one input device comprises at least one of a button and a touch sensitive screen.

5. The gaming apparatus of claim 1, wherein the at least one display device comprises a video display screen.

6. The gaming apparatus of claim 1, wherein the least one processor is configured to operate with the at least one display device and at least one input device to:

(a) after the symbols which are generated for the play of game by the second group of reels are displayed and before causing a third group of the plurality of reels to display symbols which are generated for the play of the game by the third group of reels, the third group of reels including at least one and less than all of the plurality of reels, the third group of reels not including any of the reels of the first group and the second group, receive a selection of one of the plurality of pay lines for at least another one of the designated quantity of the plurality of pay lines which will be evaluated for winning symbol combinations for the play of the game; and (b) after the selection of one of the plurality of pay lines for the at least another one of the designated quantity of the plurality of pay lines is received, cause the third group of reels to display symbols which are generated for the play of the game by the third group of reels.

7. A method of operating a gaming device, said method comprising:

displaying a plurality of reels, each of the reels displayed at a separate symbol display position, each of the reels displaying a plurality of symbols;

displaying a plurality of different pay lines associated with the plurality of reels, each of the pay lines including one location from each of the separate symbol display positions;

before displaying any of the plurality of symbols which are generated for a play of a game, receiving a wager for a designated quantity of the plurality of pay lines which will be evaluated for winning symbol combinations for the play of the game, said designated quantity being at least one and less than a number equal to all of the pay lines;

before enabling a player to select one of the plurality of pay lines for each of the designated quantity of the plurality of pay lines which will be evaluated for winning symbol combinations for the play of the game, causing a first group of the plurality of reels to display symbols which are generated for the play of the game by the first group of reels, the first group of reels including at least one and less than all of the plurality of reels;

after the symbols which are generated for the play of the game by the first group of reels are displayed and before causing a second group of the plurality of reels to display symbols which are generated for the play of the game by the second group of reels, the second group of reels including at least one and less than all of the plurality of reels, the second group of reels not including any of the reels of the first group, receiving a selection of one of the plurality of pay lines for at least one of the designated quantity of the plurality of pay lines which will be evaluated for winning symbol combinations for the play of the game;

after the selection of one of the plurality of pay lines for the at least one of the designated quantity of pay lines is received, causing the second group of reels to display symbols which are generated for the play of the game by the second group of reels; and determining a pay out by evaluating each selected pay line for any winning symbol combinations.

8. The method of claim 7, wherein receiving the selection of one of the plurality of pay lines comprises receiving a selection of at least one area associated with at least one separate symbol display position of the first group of the plurality of reels.

9. The method of claim 7, wherein receiving the selection of one of the plurality of pay lines comprises receiving the selection within an amount of time after the symbols which are generated for the play of the game by the first group of the plurality of reels are displayed.

10. The method of claim 7, wherein receiving the selection of one of the plurality of pay lines comprises receiving a plurality of selections for the same pay line.

11. The method of claim 7, further comprising receiving a selection of the reels to be included in the first group.

12. The method of claim 7, wherein causing the first group of the plurality of reels to display symbols which are generated for the play of the game by the first group of the plurality of reels comprises displaying the symbols on a video display, and causing the second group of the plurality of reels which are generated for the play of the game by the second group of the plurality of reels comprises displaying the symbols on the video display.

13. The method of claim 7, wherein receiving the wager for the designated quantity of the plurality of pay lines comprises receiving the wager in the form of at least one of a coin, a bill, a debit card, a credit card, and a casino card.

14. The method of claim 7, including after the symbols which are generated for the play of game by the second group of reels are displayed and before causing a third group of the plurality of reels to display symbols which are generated for the play of the game by the third group of reels, the third group of reels including at least one and less than all of the plurality of reels, the third group of reels not including any of the reels of the first group and the second group, receiving a selection of one of the plurality of pay lines for at least another one of the designated quantity of the plurality of pay lines which will be evaluated for winning symbol combinations for the play of the game; and after the selection of one of the plurality of pay lines for the at least another one of the designated quantity of the plurality of pay lines is received, causing the third group of reels to display symbols which are generated for the play of the game by the third group of reels.

15. The method of claim 14, wherein causing the third group of the plurality of reels to display at least one symbol comprises causing each of the plurality of reels of the third group to display at least one of the plurality of symbols.

16. A gaming apparatus comprising:

at least one display device having a separate symbol display area for each of a plurality of reels;

at least one input device;

at least one processor configured to operate with the at least one display device and at least one input device to:

(a) display the plurality of reels, each of the reels displayed at a separate symbol display position, each of the reels having a plurality of symbols;

(b) display a plurality of different pay lines associated with the plurality of reels, each of the pay lines including one location from each of the separate symbol display positions;

(c) before displaying any of the plurality of the symbols which are generated for a play of a game, receive a wager for a designated quantity of the plurality of pay lines which will be evaluated for winning symbol combinations for the play of the game, said designated quantity being at least one and less than a number equal to all of the pay lines;

(d) before enabling a player to select one of the plurality of pay lines for at least one of the designated quantity of the plurality of pay lines which will be evaluated for winning symbol combinations for the play of the game, cause a first group of the plurality of reels to each display at least one symbol which is generated for the play of the game by the first group of reels, the first group of reels including at least one and less than all of the plurality of reels;

(e) after the at least one symbol which is generated for the play of the game by the first group of reels is displayed and before causing a second group of the plurality of reels to each display at least one symbol which is generated for the play of the game by the second group of reels, the second group of reels including at least one and less than all of the plurality of reels, the second group of reels not including any of the reels of the first group, receive a selection of one of the plurality of pay lines for at least one of the designated quantity of the plurality of pay lines which will be evaluated for winning symbol combinations for the play of the game;

(f) after the selection of one of the plurality of pay lines for each of the designated quantity of pay lines is received, cause the second group of reels to display at least one symbol which is generated for the play of the game by the second group of reels; and (g) determine a pay out by evaluating each selected pay line for any winning symbol combinations.

17. The gaming apparatus of claim 16, wherein the at least one processor is configured to operate with the at least one display device to cause each of the plurality of reels of the first group to display at least one of the plurality of symbols.

18. The gaming apparatus of claim 16, wherein the at least one processor is configured to operate with the at least one display device to cause each of the plurality of reels of the second group to display at least one of the plurality of symbols.

19. The gaming apparatus of claim 16, wherein the at least one processor is configured to operate with at least one display device and the at least one input device to receive a plurality of selections of one of the plurality of pay lines after the at least one symbol which is generated for the play of the game by the first group of the plurality of reels is displayed.

20. The gaming apparatus of claim 16, wherein the at least one input device comprises at least one of a coin acceptor, a bill acceptor, and a debit/credit/casino card reader.

21. The gaming apparatus of claim 16, wherein the at least one input device comprises at least one of a button and a touch sensitive screen.

22. The gaming apparatus of claim 16, wherein the at least one display device comprises a video display screen.

23. The gaming apparatus of claim 16, wherein the least one processor is configured to operate with the at least one display device and at least one input device to:

(a) after the at least one symbol which is generated for the play of game by the second group of reels is displayed and before causing a third group of the plurality of reels to each display at least one symbol which is generated for the play of the game by the third group of reels, the third group of reels including at least one and less than all of the plurality of reels, the third group of reels not including any of the reels of the first group and the second group, receive a selection of one of the plurality of pay lines for at least another one of the designated quantity of the plurality of pay lines which will be evaluated for winning symbol combinations for the play of the game; and (b) after the selection of one of the plurality of pay lines for the at least another one of the designated quantity of the plurality of pay lines is received, cause the third group of reels to each display at least one symbol which is generated for the play of the game by the third group of reels.

24. The gaming apparatus of claim 23, wherein the at least one processor is configured to operate with the at least one display device to cause each of the plurality of reels of the third group to display a plurality of symbols.

25. The gaming apparatus of claim 23, wherein the at least one processor is configured to operate with at least one display device and the at least one input device to receive a plurality of selections of one of the plurality of pay lines for at least another one of the designated quantity of the plurality of pay lines after the at least one symbol which is generated for the play of the game by the second group of the plurality of reels is displayed.

26. A method of operating a gaming device, said method comprising:

displaying a plurality of reels, each of the reels displayed at a separate symbol display position, each of the reels having a plurality of symbols;

displaying a plurality of different pay lines associated with the plurality of reels, each of the pay lines including one location from each of the separate symbol display positions;

before displaying any of the plurality of the symbols which are generated for a play of a game, receiving a wager for a designated quantity of the plurality of pay lines which will be evaluated for winning symbol combinations for the play of the game, said designated quantity being at least one and less than a number equal to all of the pay lines;

before enabling a player to select one of the plurality of pay lines for each of the designated quantity of the plurality of pay lines which will be evaluated for winning symbol combinations for the play of the game, causing a first group of the plurality of reels to each display at least one symbol which is generated for the play of the game by the first group of reels, the first group of reels including at least one and less than all of the plurality of reels;

after the at least one symbol which is generated for the play of the game by the first group of the plurality of reels is displayed and before causing a second group of the plurality of reels to each display at least one symbol which is generated for the play of the game by the second group of reels, the second group of reels including at least one and less than all of the plurality of reels, the second group of reels not including any of the reels of the first group, receiving a selection of one of the plurality of pay lines for at least one of the designated quantity of the plurality of pay lines which will be evaluated for winning symbol combinations for the play of the game;

after the selection of one of the plurality of pay lines for the at least one of the designated quantity of pay lines is received, causing the second group of reels to each display at least one symbol which is generated for the play of the game by second group of reels; and determining a pay out by evaluating each selected pay line for any winning symbol combinations.

27. The method of claim 26, wherein causing the first group of the plurality of reels to each display at least one symbol comprises causing each of the plurality of reels of the first group to display at least one of the plurality of symbols.

28. The method of claim 26, wherein causing the first group of the plurality of reels to each display at least one symbol comprises causing each of the plurality of reels of the first group to display a plurality of symbols.

29. The method of claim 26, wherein causing the second group of the plurality of reels to each display at least one symbol comprises causing each of the reels of the second group to display a plurality of symbols.

30. The method of claim 26, wherein receiving the selection of one of the plurality of pay lines comprises receiving a selection of at least one area associated with at least one separate symbol display position of the first group of the plurality of reels.

31. The method of claim 26, wherein receiving the selection of one of the plurality of pay lines comprises receiving the selection within an amount of time after the at least one symbol which is generated for the play of the game by the first group of the plurality of reels is displayed.

32. The method of claim 26, wherein receiving the selection of one of the plurality of pay lines comprises receiving a plurality of selections for the same pay line.

33. The method of claim 26, wherein receiving the selection of one of the plurality of pay lines comprises receiving a plurality of selections for the same pay line.

34. The method of claim 26, further comprising:

receiving a selection of the reels to be included in the first group; and receiving a selection of the reels to be included in the second group.

35. The method of claim 26, wherein receiving the wager for the designated quantity of the plurality of pay lines comprises receiving the wager in the form of at least one of a coin, a bill, a debit card, a credit card, and a casino card.

36. The method of claim 26, including after the at least one symbol which is generated for the play of the game by the second group of the plurality of the reels is displayed and before causing a third group of the plurality of reels to each display at least one symbol which is generated for the play of the game by the third group of reels, the third group of reels including at least one and less than all of the plurality of reels, the third group of reels not including any of the reels of the first group and the second group, receiving a selection of one of the plurality of pay lines for at least another one of the designated quantity of the plurality of pay lines which will be evaluated for winning symbol combinations for the play of the game; and after the selection of one of the plurality of pay lines for the at least another one of the designated quantity of pay lines is received, causing the third group of reels to each display at least one symbol which is generated for the play of the game by the third group of reels.

37. The method of claim 36, wherein receiving the selection of one of the plurality of pay lines for at least another one of the designated quantity of the plurality of pay lines comprises receiving a selection of at least one area associated with at least one separate symbol display position of the second group of the plurality of reels.

38. The method of claim 36, wherein receiving the selection of one of the plurality of pay lines for at least another one of the designated quantity of the plurality of pay lines comprises receiving the selection within an amount of time after the at least one symbol which is generated for the play of the game by the second group of reels is displayed.

39. The method of claim 36, wherein causing the first group of the plurality of reels to each display at least one symbol which is generated for the play of the game by the first group of the plurality of reels comprises displaying said at least one symbol on a video display, wherein causing the second group of reels to each display at least one symbol which is generated for the play of the game by the second group of the plurality of reels comprises displaying said at least one symbol on the video display, and wherein causing the third group of the plurality of reels to each display at least one symbol which is generated for the play of the game by the third group of reels comprises said at least one symbol on the video display.

40. A gaming device comprising:

at least one display device;

at least one input device; and at least one processor configured to operate with the at least one display device and at least one input device to:

(A) prior to displaying a partial outcome for a play of a game, receive a wager for a designated quantity of pay lines, said designated quantity being at least one and less than a number equal to all of the pay lines, (B) prior to enabling a player to select one of the pay lines for each of the designated quantity of the plurality of pay lines which will be evaluated for winning symbol combinations for the play of the game, display the partial outcome of said play of the game, (C) enable the player to select at least one of the pay lines for each of the designated quantity of the plurality of pay lines after the partial outcome is displayed and prior to evaluation of any outcome of said play of the game, and (D) display a full outcome of said play of the game after the player selects the at least one pay line.

41. The gaming device of claim 40, wherein the least one processor is configured to operate with the at least one display device and at least one input device to enable the player to make a second wager after the partial outcome is displayed and prior to evaluation of any outcome of said play of the game.

42. The gaming device of claim 40, wherein the partial outcome includes at least one symbol for each of a plurality of paylines.

43. A method of operating a gaming device comprising:

prior to displaying a partial outcome for a play of a game, receiving a wager for a designated quantity of pay lines, said designated quantity being at least one and less than a number equal to all of the pay lines;

prior to enabling a player to select one of the pay lines for each of the designated quantity of the plurality of pay lines which will be evaluated for winning symbol combinations for the play of the game, displaying the partial outcome of said play of the game;

for each of the designated quantity of pay lines, enabling the player to select at least one of the pay lines for said play of the game after the partial outcome is displayed and prior to evaluation of any outcome of said play of the game; and displaying a full outcome of said play of the game after the player selects the at least one pay line.

* * * * *

UNITED STATES PATENT AND TRADEMARK OFFICE

CERTIFICATE OF CORRECTION

PATENT NO. : 7,594,849 B2
APPLICATION NO. : 11/042001
DATED : September 29, 2009
INVENTOR(S) : Lee E. Cannon It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 694 days.

Signed and Sealed this

Twenty-eighth Day of September, 2010

David J. Kappos

David J. Kappos
*Director of the United States Patent and Trademark Office*